US006280798B1

(12) United States Patent
Ring et al.

(10) Patent No.: US 6,280,798 B1
(45) Date of Patent: Aug. 28, 2001

(54) FLUIDIZED BED POWDER COATING PROCESS UTILIZING TRIBOSTATIC CHARGING

(75) Inventors: John Ring, Newcastle upon Tyne; Kevin J. Kittle, Co. Durham, both of (GB); Gianfranco Arpe, Alessandria (IT)

(73) Assignee: International Coatings Limited, London (GB)

( * ) Notice: Subject to any disclaimer, the term of this patent is extended or adjusted under 35 U.S.C. 154(b) by 0 days.

(21) Appl. No.: 09/555,884

(22) PCT Filed: Dec. 16, 1998

(86) PCT No.: PCT/GB98/03777

§ 371 Date: Jul. 24, 2000

§ 102(e) Date: Jul. 24, 2000

(87) PCT Pub. No.: WO99/30838

PCT Pub. Date: Jun. 24, 1999

(30) Foreign Application Priority Data

Dec. 17, 1997 (GB) ..... 9726645
Sep. 30, 1998 (GB) ..... 9821195

(51) Int. Cl.[7] ..... B05D 1/24; B05C 19/04

(52) U.S. Cl. ..... 427/459; 427/461; 118/634; 118/DIG. 5

(58) Field of Search ..... 427/459–461; 361/226; 118/634, DIG. 5

(56) References Cited

U.S. PATENT DOCUMENTS

| | | | | |
|---|---|---|---|---|
| 3,502,492 | | 3/1970 | Spiller . | |
| 3,670,699 | * | 6/1972 | Sargent | 118/629 |
| 3,871,328 | * | 3/1975 | English . | |
| 4,072,795 | | 2/1978 | Noonan . | |
| 4,086,872 | | 5/1978 | Pan . | |
| 4,188,413 | * | 2/1980 | Lupinski et al. . | |
| 4,811,689 | | 3/1989 | Yamamoto et al. . | |

FOREIGN PATENT DOCUMENTS

| | | |
|---|---|---|
| 2519963 | 11/1975 | (DE) . |
| 126791 | 8/1977 | (DE) . |
| 242353 | 9/1996 | (DE) . |
| 19616695 | 11/1997 | (DE) . |
| 0045045 | 2/1982 | (EP) . |
| 1360556 | 8/1964 | (FR) . |
| 899275 | 6/1962 | (GB) . |
| 1012364 | 12/1965 | (GB) . |
| 1046613 | 10/1966 | (GB) . |
| 1059166 | 2/1967 | (GB) . |
| 1509379 | 5/1978 | (GB) . |
| 9533576 | 12/1995 | (WO) . |

OTHER PUBLICATIONS

The Chambers Dictionary, New Edition, p. 1849 Undated.
The Chambers Dictionary of Science and Technology, p. 1193 Undated.
Physical Laboratory Handbook, First English–language Edition, Sir Isaac Pitman & Sons Ltd., London, 1966, p. 326.

* cited by examiner

*Primary Examiner*—Fred J. Parker
(74) *Attorney, Agent, or Firm*—Burns, Doane, Swecker & Mathis, L.L.P.

(57) ABSTRACT

A process for forming a coating on a conductive substrate, which comprises establishing a fluidized bed of a powder coating composition, in which the mechanism for particle charging is tribostatic charging immersing the substrate wholly or partly within the said fluidized bed, applying a voltage to the substrate for at least part of the period of immersion, whereby particles of the powder coating composition adhere to the substrate, withdrawing the substrate from the fluidized bed and forming the adherent particles into a continuous coating over at least part of the substrate.

The process enables the coating of substrate areas which, because of the Faraday cage effect, are inaccessible in conventional electrostatic coating processes, and also enables the formation of thinner coatings than are obtainable by conventional fluidized-bed processes.

42 Claims, 14 Drawing Sheets

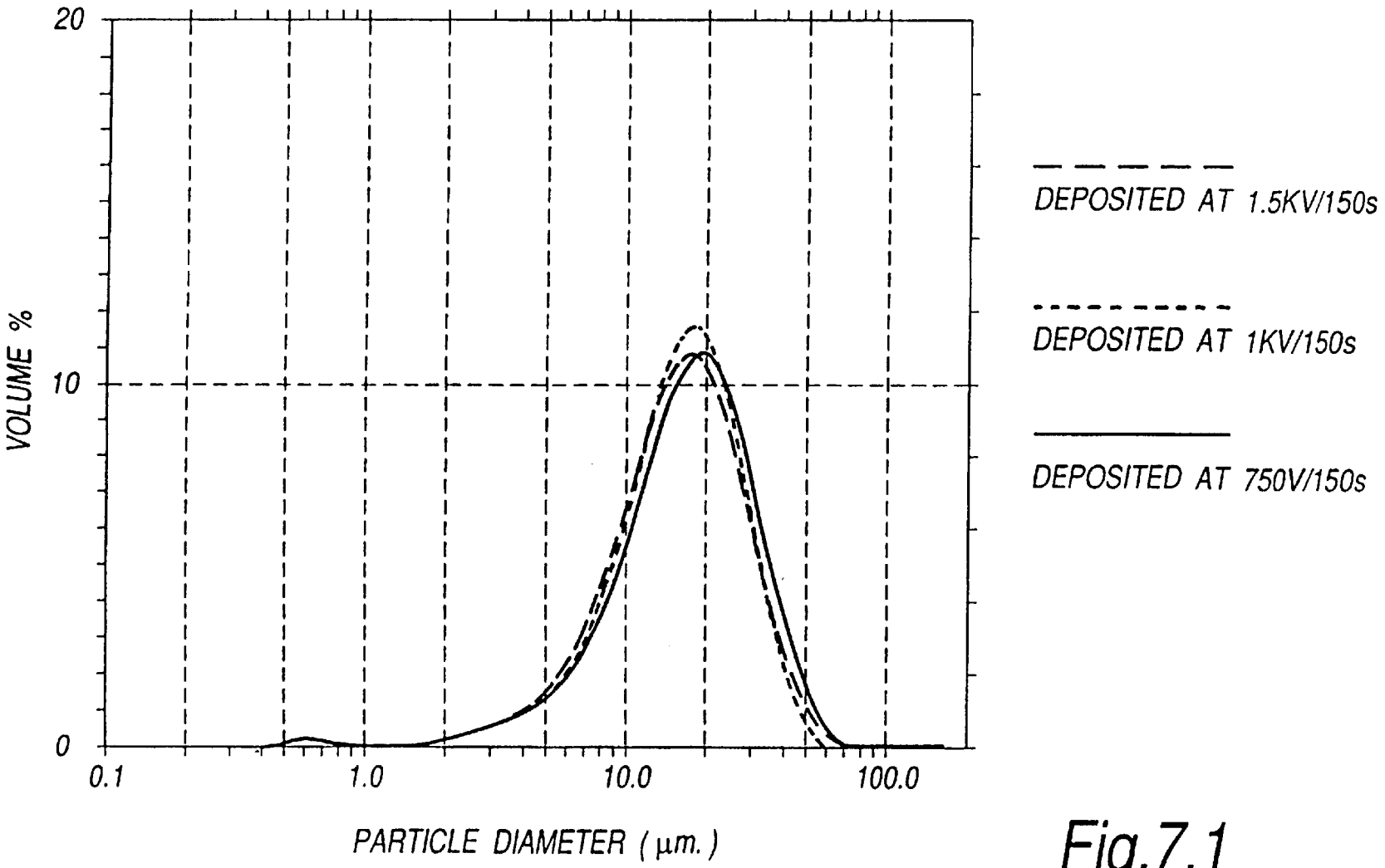
Fig.7.1

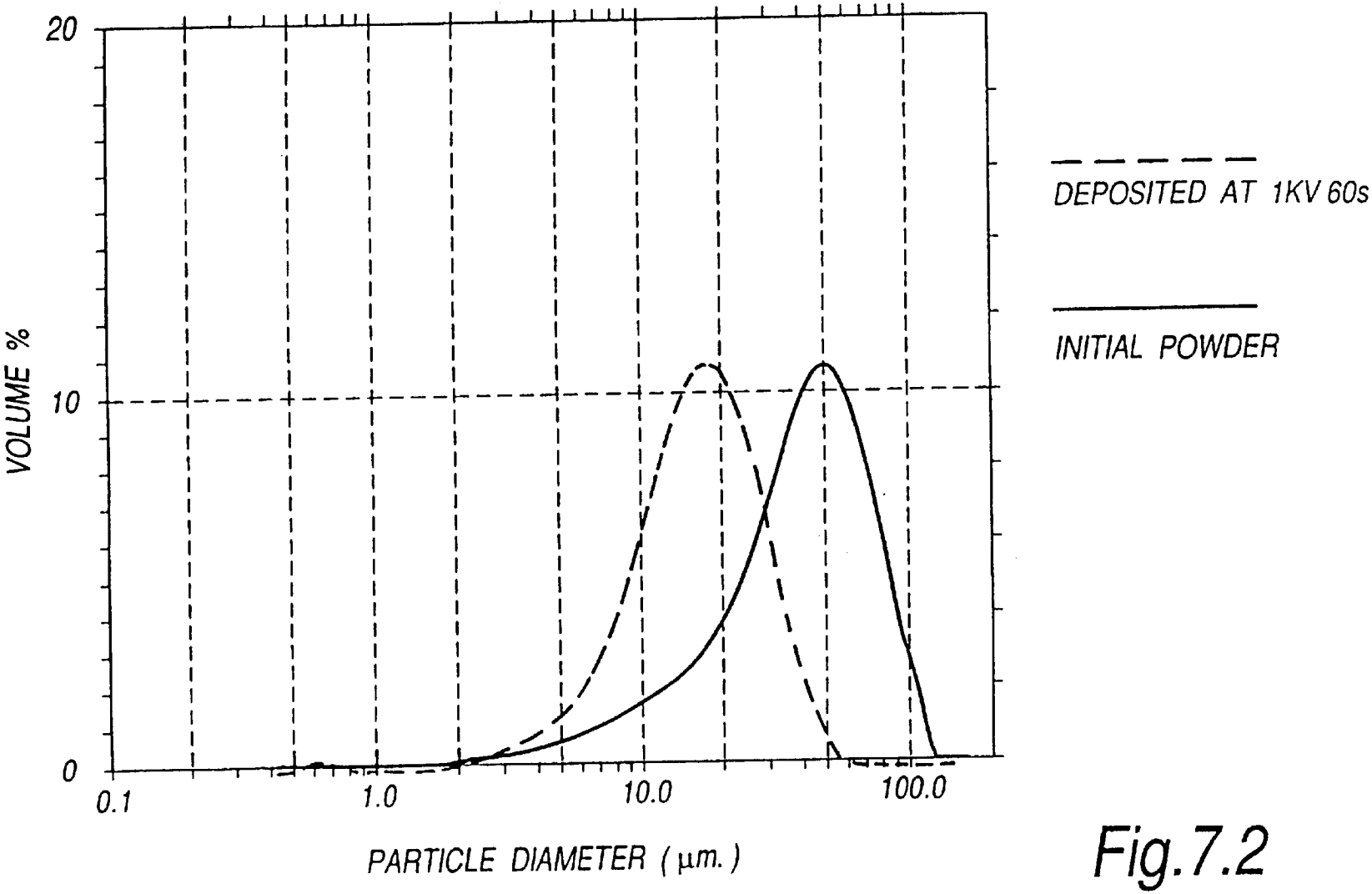
Fig.7.2

FLUIDIZED BED POWDER COATING PROCESS UTILIZING TRIBOSTATIC CHARGING

BACKGROUND OF THE INVENTION

1. Field of the Invention

This invention relates to a process for the application of powder coating compositions to substrates.

2. Background Information

Powder coatings form a rapidly growing sector of the coatings market. Powder coatings are solid compositions which are generally applied by an electrostatic spray process in which the powder coating particles are electrostatically charged by the spray gun and the substrate (normally metallic) is earthed. The charge on the powder coating particles is normally applied by interaction of the particles with ionised air (corona charging) or by friction (tribostatic or "tribo" charging). The charged particles are transported in air towards the substrate and their final deposition is influenced inter alia by the electric field lines that are generated between the spray gun and the workpiece. A disadvantage of this process is that there are difficulties in coating articles having complicated shapes, and especially articles having recessed portions, as a result of restricted access of the electric field lines into recessed locations (the Faraday cage effect), especially in the case of the relatively strong electric fields generated in the corona-charging process. The Faraday cage effect is much less evident in the case of tribostatic charging processes, but those processes have other drawbacks.

As an alternative to electrostatic spray processes, powder coating compositions may be applied by fluidised-bed processes, in which the substrate workpiece is preheated (typically to 200° C.–400° C. ) and dipped into a fluidised bed of the powder coating composition. The powder particles that come into contact with the preheated surface melt and adhere to the workpiece. In the case of thermosetting powder coating compositions, the initially-coated workpiece may be subjected to further heating to complete the curing of the applied coating. Such post-heating may not be necessary in the case of thermoplastic powder coating compositions.

Fluidised-bed processes eliminate the Faraday cage effect, thereby enabling recessed portions in the substrate workpiece to be coated, and are attractive in other respects, but have the well-known disadvantage that the applied coatings are substantially thicker than those obtainable by electrostatic coating processes.

Another alternative application technique for powder coating compositions is the so-called electrostatic fluidised-bed process, in which the fluidising air is ionised by means of charging electrodes arranged in the fluidising chamber or, more usually, in the plenum chamber below the porous air-distribution membrane. The ionised air charges the powder particles, which acquire an overall upwards motion as a result of electrostatic repulsion of identically charged particles. The effect is that a cloud of charged powder particles is formed above the surface of the fluidised bed. The substrate workpiece (earthed) is introduced into the cloud and powder particles are deposited on the substrate surface by electrostatic attraction. No preheating of the substrate workpiece is required.

The electrostatic fluidised-bed process is especially suitable for coating small articles, because the rate of deposition of the powder particles becomes less as the article is moved away from the surface of the charged bed. Also, as in the case of the traditional fluidised-bed process, the powder is confined to an enclosure and there is no need to provide equipment for recycling and reblending the overspray that is not deposited on the substrate. As in the case of the corona-charging electrostatic process, however, there is a strong electric field between the charging electrodes and the substrate workpiece and, as a result, the Faraday cage effect operates to a certain extent and leads to poor deposition of powder particles into recessed locations on the substrate.

DD-A-126 791 discloses an electrostatic fluidised-bed process employing an apparatus including a fluidised bed of powdered material in a fluidised layer of which are located charging electrodes. In the discussion of the prior art, suitable charging electrodes are indicated as being in the form of needles, wires or plates maintained at a high voltage for the purpose of generating ions which attach themselves to powder particles and cause them to be deposited on a workpiece in the fluidised bed. DD-A-126 791 is directed to arrangements including porous charging electrodes.

GB-A-1 059 166 discloses an apparatus, which does not include a fluidised bed, in which an article to be coated is connected to a source of high voltage while suspended in a tank. Finely powdered plastics material contained in the tank is made to form a mist and to coat the article by an electromotive force exerted on the powdered plastics material by the high voltage of the article to be coated combined with a degree of agitation of the powdered plastics material.

SUMMARY OF THE INVENTION

The present invention provides a process for forming a coating on a conductive substrate, which comprises establishing a fluidised bed of a powder coating composition, thereby effecting tribostatic charging of the powder coating composition, immersing the substrate wholly or partly within the said fluidised bed, applying a voltage to the substrate for at least part of the period of immersion, whereby charged particles of the powder coating composition adhere to the substrate, withdrawing the substrate from the fluidised bed and forming the adherent particles into a continuous coating over at least part of the substrate.

In general, the process comprises the steps of establishing a fluidised bed of a powder coating composition, immersing the substrate wholly or partially within the said fluidised bed, applying a voltage to the substrate for at least part of the period of immersion, whereby particles of the powder coating composition are charged substantially by friction alone and adhere to the substrate, withdrawing the substrate from the fluidised bed and forming the adherent particles into a continuous coating over at least part of the substrate.

Conversion of the adherent particles into a continuous coating (including, where appropriate, curing of the applied composition) may be effected by heat treatment and/or by radiant energy, notably infra-red, ultra-violet or electron beam radiation.

In the process of the present invention, particles of the powder coating composition adhere to the substrate as a result of the frictional charging (tribostatic or "tribo" charging) of the particles as they rub against one another in circulating in the fluidised bed. As compared with processes in which a substantial electric field is generated between charging electrodes and the substrate workpiece, the process of the present invention offers the possibility of achieving good coating of substrate areas which are rendered inaccessible by the Faraday cage effect.

The process of the present invention is conducted without ionisation or corona effects in the fluidised bed.

The voltage applied to the substrate is sufficient to attract the frictionally charged powder coating particles to the substrate while resulting in a maximum potential gradient that is insufficient to produce either ionisation or corona effects in the fluidised bed of powder coating composition. Air at atmospheric pressure usually serves as the gas in the fluidised bed but other gases may be used, for example, nitrogen or helium.

Since the voltage applied to the substrate is insufficient to produce either ionisation or corona effects in the fluidised bed of powder coating composition, the substrate is, in effect, electrically isolated and there is effectively no current flow in the substrate. If there is any current flow, it is anticipated that it is unlikely to be more than 10 mA, probably unlikely to be more than 5 mA and expected to be less than 1 mA and more likely to be of the order of a few microamps; that is, the current is, in practice, expected to be too small to be measured by conventional current-measuring instruments.

As compared with traditional fluidised-bed application technology, the process of the invention offers the possibility of applying thinner coatings in a controlled manner since frictional charging has been found to become more efficient as particle sizes are reduced. Improvements in efficiency as particle sizes are reduced contrasts with the situation for powder coating using a triboelectric gun where efficiency falls as particle sizes are reduced. Also, compared with traditional fluidised-bed application technology, pre-heating of the substrate is not an essential step in the process of the invention.

The uniformity of the coating may be improved by shaking or vibrating the workpiece in order to remove loose particles.

Powder coating compositions generally comprise a solid film-forming resin, usually with one or more colouring agents such as pigments, and optionally also contain one or more performance additives.

A powder coating composition for use according to the invention will in general be a thermosetting system (incorporating, for example, a film-forming polymer and a corresponding curing agent which may itself be another film-forming polymer), but thermoplastic systems (based, for example, on polyamides) can in principle be used instead.

The film-forming polymer used in the manufacture of a thermosetting powder coating composition for use according to the invention may be one or more selected from carboxy-functional polyester resins, hydroxy-functional polyester resins, epoxy resins, and functional acrylic resins.

The composition may, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10–100, a number average molecular weight Mn of 1,500 to 10,000 and a glass transition temperature Tg of from 30° C. to 85° C., preferably at least 40° C. The poly-epoxide can, for example, be a low molecular weight epoxy compound such as triglycidyl isocyanurate (TGIC), a compound such as diglycidyl terephthalate or diglycidyl isophthalate, an epoxy resin such as a condensed glycidyl ether of bisphenol A or a light-stable epoxy resin. Such a carboxyfunctional polyester film-forming resin can alternatively be used with a bis(beta-hydroxyalkylamide) curing agent such as tetrakis (2-hydroxyethyl)adipamide.

Alternatively, a hydroxy-functional polyester can be used with a blocked isocyanate-functional curing agent or an amine-formaldehyde condensate such as, for example, a melamine resin, a urea-formaldehyde resin, or a glycol ural formaldehyde resin, for example, the material "Powderlink 1174" supplied by the Cyanamid Company, or hexahydroxymethyl melamine. A blocked isocyanate curing agent for a hydroxy-functional polyester may, for example, be internally blocked, such as the uret dione type, or may be of the caprolactam-blocked type, for example, isopherone diisocyanate.

As a further possibility, an epoxy resin can be used with an amine-functional curing agent such as, for example, dicyandiamide. Instead of an amine-functional curing agent for an epoxy resin, a phenolic material may be used, preferably a material formed by reaction of epichlorohydrin with an excess of bisphenol A (that is to say, a polyphenol made by adducting bisphenol A and an epoxy resin). A functional acrylic resin, for example a carboxy-, hydroxy- or epoxy-functional resin can be used with an appropriate curing agent. Mixtures of binders can be used, for example a carboxy-functional polyester can be used with a carboxy-functional acrylic resin and a curing agent such as a bis (beta-hydroxyalkylamide) which serves to cure both polymers. As further possibilities, for mixed binder systems, a carboxy-, hydroxy- or epoxyfunctional acrylic resin may be used with an epoxy resin or a polyester resin (carboxy- or hydroxy-functional). Such resin combinations may be selected so as to be co-curing, for example, a carboxy-functional acrylic resin co-cured with an epoxy resin, or a carboxy-functional polyester co-cured with a glycidyl-functional acrylic resin. More usually, however, such mixed binder systems are formulated so as to be cured with a single curing agent (for example, use of a blocked isocyanate to cure a hydroxy-functional acrylic resin and a hydroxyfunctional polyester). Another preferred formulation involves the use of a different curing agent for each binder of a mixture of two polymeric binders (for example, an amine-cured epoxy resin used in conjunction with a blocked isocyanate-cured hydroxy functional acrylic resin).

Other film-forming polymers which may be mentioned include functional fluoropolymers, functional fluorochloropolymers and functional fluoroacrylic polymers, each of which may be hydroxy-functional or carboxy-functional, and may be used as the sole film-forming polymer or in conjunction with one or more functional acrylic, polyester and/or epoxy resins, with appropriate curing agents for the functional polymers.

Other curing agents which may be mentioned include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as "Santolink LSE 120" supplied by Monsanto; and alicyclic poly-epoxides such as "EHPE-3150" supplied by Daicel.

A powder coating composition for use according to the invention may be free from added colouring agents, but usually contains one or more such agents (pigments or dyes) and can contain one or more performance additives such as a flow-promoting agent, a plasticiser, a stabiliser, for example a stabiliser against UV degradation, an anti-gassing agent, such as benzoin, a filler, or two or more such additives may be present in the coating composition. Examples of pigments which can be used are inorganic pigments such as titanium dioxide, red and yellow iron oxides, chrome pigments and carbon black and organic pigments such as, for example, phthalocyanine, azo, anthraquinone, thioindigo, isodibenzanthrone, triphendioxane and quinacridone pigments, vat dye pigments and lakes of acid, basic and mordant dyestuffs. Dyes can be used instead of or as well as pigments.

A pigment content of <40% by weight of the total composition (disregarding dry blend additives) may be used. Usually a pigment content of 25–30% is used, although in the case of dark colours opacity can be obtained with <10% by weight of pigment. Where appropriate, a filler may be used to assist opacity, whilst minimising costs.

A powder coating composition used in the process of the invention may be formulated in accordance with normal practice and, in particular, it is possible to use compositions formulated especially for corona-charging application as well as compositions formulated especially for tribo-charging application (for example, for the latter, by the use of suitable polymers of which the so-called "tribo-safe" grades are an example or by the use of additives which can be introduced prior to extrusion in a manner known per se).

The powder coating composition may incorporate, by dry-blending, one or more fluidity-assisting additives, for example, those disclosed in WO 94/11446, and especially the preferred additive combination disclosed in that Specification, comprising aluminium oxide and aluminium hydroxide. Other dry-blended additives which may be mentioned include aluminium oxide and silica, either singly or in combination.

The total content of dry-blended additive(s) incorporated with the powder coating composition will in general be in the range of from 0.01% to 10% by weight preferably at least 0.1% by weight and not exceeding 1.0% by weight (based on the total weight of the composition without the additive(s)).

The voltage applied to the substrate in the process of the present invention is preferably a direct voltage, either positive or negative, but an alternating voltage is also usable in principle. The applied voltage may vary within wide limits according, inter alia, to the size of the fluidised bed, the size and complexity of the workpiece and the film thickness desired. On this basis, the applied voltage will in general be in the range of from 100 volts to 100 kilovolts, more usually from 200 volts to 60 kilovolts, preferably from 300 volts to 30 kilovolts, more especially from 500 volts to 5 kilovolts, both positive and negative when a direct voltage is used.

Other possible voltage ranges include 5 to 60 kilovolts, 15 kilovolts to 35 kilovolts, 5 kilovolts to 30 kilovolts and 30 kilovolts to 60 kilovolts, both positive and negative when a direct voltage is used.

In each case, ionisation and corona conditions may be excluded by so selecting the voltage range according to the spacing of the substrate from elements of the apparatus as to cause a maximum potential gradient below 30 kV/cm., the ionisation potential gradient for air at atmospheric pressure, when air serves as the gas in the fluidised bed, operation usually being at atmospheric pressure. Either nitrogen or helium, for example, instead of air, could serve as the gas in the fluidised bed and, for operation at about atmospheric pressure, a maximum potential gradient below 30 kV/cm would be suitable for use with those gases.

The voltage may be applied to the substrate before it is immersed in the fluidised bed and not disconnected until after the substrate has been removed from the bed. Alternatively, the voltage may be applied only after the substrate has been immersed in the fluidised-bed. Optionally, the voltage may be disconnected before the substrate is withdrawn from the fluidised-bed.

The substrate will usually be wholly immersed within the fluidised bed.

The preferred period of immersion of the workpiece in a charged condition will depend on the size and geometrical complexity of the substrate, the film thickness required, and the magnitude of the applied voltage and will generally be in the range of from 30 seconds to 5 minutes.

Preferably, the substrate is moved in a regular or intermittent manner during its period of immersion in the fluidised bed. The motion may, for example, be linear, rotary and/or oscillatory. As is indicated above, the substrate may, additionally, be shaken or subjected to vibration in order to remove particles adhering only loosely to it. As an alternative to a single immersion, the substrate may be repeatedly immersed and withdrawn until the desired total period of immersion has been achieved.

The pressure of the fluidising gas (normally air) will depend on the bulk of the powder to be fluidised, the fluidity of the powder, the dimensions of the fluidised bed, and the pressure difference across the porous membrane, and will generally be in the range of from 0.1 to 5.0 bar. Possible ranges include 0.5 to 4.0 bar and in certain circumstances 2.0 to 4.0 bar would be suitable.

The particle size distribution of the fluidised powder coating composition may be in the range of from 1 to 120 microns, with a mean particle size within the range 15 to 75 microns, preferably 25 to 50 microns, more especially 20 to 45 microns.

Finer size distributions may be preferred, especially where relatively thin applied films are required, for example, compositions in which one or more of the following criteria is satisfied:

a) 95–100% by volume <50 μm b) 90–100% by volume <40 μm c) 45–100% by volume <20 μm d) 5–100% by volume <10 μm preferably 10–70% by volume <10 μm e) 1–80% by volume <5 μm preferably 3–40% by volume <5 μm f) $d(v)_{50}$ in the range 1.3–32 μm preferably 8–24 μm The thickness of the applied coating may be in the range of from 5 to 200 microns or 5 to 100 microns, more especially from 10 to 150 microns, possibly from 20 to 100 microns, 60 to 80 microns or 80 to 100 microns or 50 to 150 microns, advantageously 50 microns or less, and preferably from 15 to 40 microns. The principal factor affecting the thickness of the coating is the applied voltage, but the duration of the period of immersion in charged condition also has an influence.

The substrate comprises metal (for example, aluminium or steel) or another conductive material, and may in principle be of any desired shape and size. Advantageously, the substrate is chemically or mechanically cleaned prior to application of the composition, and, in the case of metal substrates, is preferably subjected to chemical pre-treatment, for example, with iron phosphate, zinc phosphate or chromate.

The process of the invention offers particular benefits in the automotive and other fields where it is desired to coat an article such as a car body at sufficient film build to provide adequate cover for any metal defects before applying an appropriate topcoat. According to previous practice, it has been necessary to apply two separate coats to such articles in order to provide proper preparation for the topcoat. Thus, it has been common practice to apply a first coating of an electropaint to give a barrier film over the whole metal surface, followed by a second coating of a primer surfacer to ensure proper covering of any visible defects. By contrast, the present invention offers the possibility of achieving adequate protective and aesthetic coverage, even of articles of complex geometry, by means of a single coating applied by the process of the invention. Also, the coating process can be adapted to produce relatively high film thicknesses in a single operation if required.

The invention accordingly also provides a process for coating automotive components, in which a first coating derived from a powder coating composition is applied by means of the process of the invention as herein defined, and thereafter a topcoat is applied over the powder coating.

Mention should also be made of applications of the process of the invention in the aerospace industry, where it is of particular advantage to be able to apply uniform coatings at minimum film weights to substrates (especially aluminium or aluminium-alloy substrates) of a wide range of geometric configurations in an environmentally-compliant manner.

The process of the invention is capable of dealing with articles such as wire baskets and freezer shelves which include welds and projections, providing a uniform coating of powder on the welds and projections as well as on the remainder of the articles. Alternative coating processes, in contrast, may be expected to yield non-uniform coatings on articles such as wire baskets and freezer shelves since, with the alternative coating processes, adequate covering of welds is often achieved only with over-covering of the projections.

Advantageously, the fluidised bed is provided with an electrical connection, serving as the source of the reference or "earth" voltage for the remainder of the apparatus. If no connection is provided, it may be found that the coating performance of the fluidised bed deteriorates more quickly than would otherwise be the case. For safety reasons, the fluidised bed is, preferably, connected to the earth terminal of the electrical mains supply (referred to as an earth connection) energising the apparatus.

Advantageously, to minimise charge leakage, the connection to the substrate is not an earth connection.

In one form of process according to the invention, one or more counter-electrodes, preferably connected to the earth terminal of the electrical mains supply energising the apparatus, are disposed within the bulk of the fluidised powder coating composition. The counter-electrodes may be charged instead of being connected to the earth terminal of the mains supply.

The counter-electrodes serve to improve the efficiency of the process according to the invention, in the coating of a substrate with recesses, for example, by so modifying the electric field within the recesses, on insertion into the recesses, as to cause greater penetration of the electric field into the recesses, thereby effecting an increase in the amount of powder attracted into the recesses. Care is taken to ensure that separations between the counter-electrodes and the substrate in relation to the voltage applied to the substrate are always such that the maximum potential gradient between a counter-electrode and the substrate lies below 30 kV/cm, the ionisation potential for air at atmospheric pressure, when air at atmospheric pressure serves as the gas in the fluidised bed. That is, the process of the invention continues to be conducted without ionisation or corona effects in the fluidised bed when counter-electrodes are used.

As is indicated above, either nitrogen or helium, for example, may be used as the fluidising gas with substantially no change to the electrical conditions in the fluidised bed.

The quantity of the powder coating composition deposited on the substrate or a series of substrates is relatively very small as compared with the quantity of the composition in the fluidised bed. Some replenishment may, however, be desirable from time to time.

As is stated above, in the process according to the invention, the charging of the powder particles is effected by natural friction between particles in the fluidised-bed. The friction between the particles in the fluidised-bed leads to bipolar charging of the particles, that is to say, a proportion of the particles will acquire a negative charge and a proportion will acquire a positive charge. The presence of both positively and negatively charged particles in the fluidised-bed may appear to be a disadvantage, especially in the preferred case in which a direct voltage is applied to the substrate, but the process of the invention is capable of accommodating the bipolar charging of the particles.

In the case in which a direct voltage of a given polarity is applied to the substrate, electrostatic forces will tend to attract predominantly oppositely-charged powder coating particles onto the substrate. The resulting removal of positively and negatively charged particles at different rates leads to a progressive reduction in the proportion of the oppositely-charged species in the bulk powder which, if uncorrected, will result in such charge distribution imbalance as to reduce the coating efficiency for successive substrates over time.

A further consequence of a significant charge distribution imbalance among the powder coating particles is that a proportion of the non-oppositely-charged powder coating particles in the fluidised-bed will tend to deposit on the walls of a fluidising chamber in which the bed is established. Continued deposition of that kind will result in the progressive accumulation of an insulating layer of powder and, as a consequence, coating efficiency will be impaired. It is possible in principle to alleviate that problem by mechanical removal of the deposited powder, with the removed powder thereby being re-introduced into the bulk fluidised composition. Such mechanical cleaning, however, is not completely reliable or effective and, moreover, re-introduction of the removed powder may contribute towards an undesirable charge distribution in the bulk fluidised composition. Where counter-electrodes are present, the counter-electrodes, too, may suffer from powder deposition when there is a significant charge imbalance among the powder coating particles.

It has been found that charge is most effectively removed from particles deposited on the walls of the fluidising chamber in which the fluidised-bed is established when the fluidising chamber is connected to the earth terminal of the mains power supply energising the apparatus. Where counter-electrodes are used, charge is most effectively removed from particles deposited on the counter-electrodes when the counter-electrodes are connected to the earth terminal of the mains supply.

Advantageously, in a process according to the invention for coating successive substrates in sequence, direct voltage is used and the polarity of the voltage applied to successive substrates is reversed from each substrate to the next so as to produce an alternating sequence. Such a process variant offers the possibility of reducing the extent of charge imbalance in the bulk fluidised powder caused by preferential deposition on the substrate of charged particles of one polarity.

Alternation of the polarity of successive substrates results in a relatively balanced long-term average distribution of positively and negatively charged particles in the fluidised-bed also serves to reduce the extent of deposition of the powder on the walls of the fluidising chamber and, when used, the counter-electrodes disposed in the fluidising chamber.

A further process variant taking account of the bipolar charging of the powder particles comprises the simultaneous batchwise coating of one or more pairs of substrates disposed within a common fluidised bed, the substrates of each pair being charged by direct voltages to respectively opposite polarities. In that process variant, the walls of the fluidising chamber are connected to the earth terminal of the mains supply and there may be provided one or more counter-electrodes, connected to the earth terminal of the mains supply, to establish a specific configuration of the electric field among the oppositely-charged substrates and the fluidising chamber.

The invention further provides a continuous process for the coating of substrates, in which a series of substrates of alternate polarities is transported through a fluidised-bed established within a fluidising chamber having walls composed alternately (in the direction of travel of the substrates) of insulating sections and conducting sections. The conducting sections of the fluidising chamber would usually be held at different voltages in order to provide different conditions in the respective sections of the chamber but it will be understood that the conductive sections would, in some circumstances, all be connected to the earth terminal of the mains supply.

In a variant of this continuous process, the alternately charged substrates are transported in sequence past an array of counter-electrodes (preferably connected to the earth terminal of the main supply) disposed within the fluidised-bed. These continuous processes offer benefits which are similar in principle to those of the individual coating of successive substrates of alternate polarities and the simultaneous coating of pairs of substrates of respectively opposing polarities.

The invention further provides apparatus for use in carrying out the process of the invention, which comprises:

(a) a fluidising chamber;

(b) means for effecting fluidisation of a bulk powder coating composition within the fluidising chamber so as to establish a fluidised bed of the composition therein, thereby effecting tribostatic charging of the powder coating composition, (c) means for immersing a substrate wholly or partly within the fluidised bed;

(d) means for applying a voltage to the substrate for at least part of the period of immersion, whereby the substrate becomes electrically charged so that charged particles of the powder coating composition adhere thereto;

(e) means for withdrawing the substrate bearing adherent particles from the fluidised bed and (f) means for converting the adherent particles into a continuous coating.

BRIEF DESCRIPTION OF THE DRAWINGS

Several forms of process in accordance with the invention, and two general forms of fluidisation and coating apparatus suitable for carrying out the process, will now be described, by way of example, with reference to the accompanying drawings (not to scale), in which:

FIGS. 6 to 12 are graphical representations of the data reported in Examples 1 to 7 hereinafter.

DETAILED DESCRIPTION OF THE PREFERRED EMBODIMENTS

Figure 1:
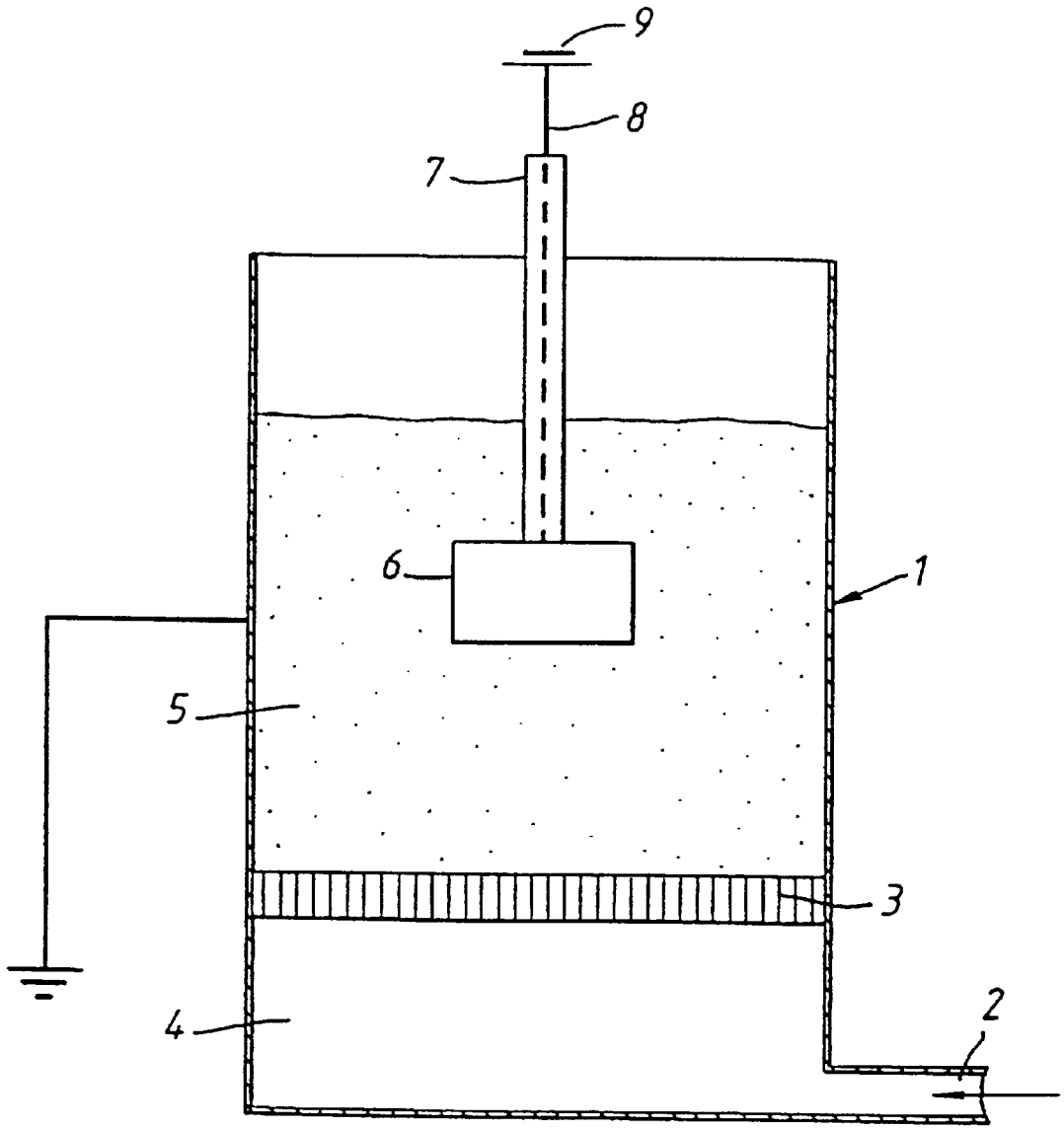
FIG. 1 shows the first form of fluidisation and coating apparatus in diagrammatic section.

Referring to FIG. 1 of the accompanying drawings, the fluidisation and coating apparatus comprises an earthed (connected to the earth terminal of the mains supply) vessel (1) having an air inlet (2) at its base and a porous air distribution membrane (3) disposed transversely so as to divide the vessel into a lower plenum (4) and an upper fluidising compartment (5).

In operation, a workpiece (6) having an insulated support (7), preferably a rigid support, is immersed into a fluidised bed of a powder coating composition established in the fluidising compartment (5) by means of an upwardly-flowing stream of air introduced from the plenum (4) through the porous membrane (3).

For at least part of the period of immersion, a direct voltage is applied to the workpiece (6) by means of a supply cable (8) from a variable voltage source (9). The workpiece becomes electrically charged and particles of the powder coating composition adhere thereto. There are no ionisation or corona effects and, for that reason, the workpiece is substantially isolated electrically, a consequence of which is that the amperage is very low.

The workpiece may be moved in a regular oscillatory manner during the coating process by means not shown in FIG. 1. Instead, the workpiece may be advanced through the bed either intermittently or continuously during immersion, or may be repeatedly immersed and withdrawn until the desired total period of immersion has been achieved.

After the desired period of immersion the workpiece is withdrawn from the fluidised bed, the applied voltage is disconnected and the workpiece is heated so as to melt and fuse the adhering particles of the powder coating composition and complete the coating.

Figure 2:
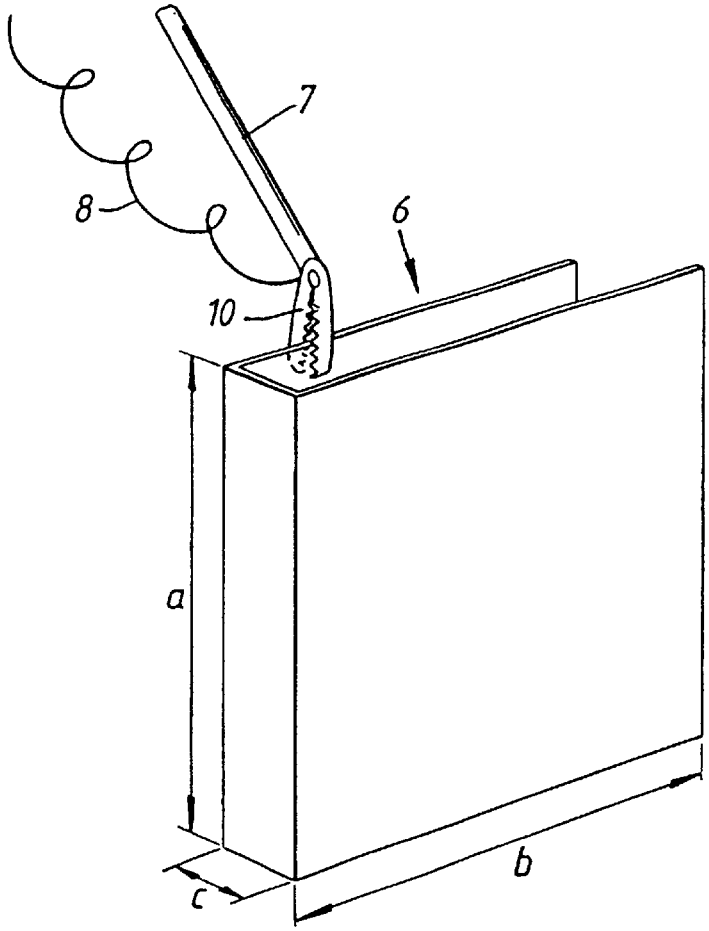
FIG. 2 is a perspective view of the substrate workpiece used in Examples 1 and 3 to 8.

Referring to FIG. 2, the workpiece comprises an aluminium panel folded as shown to give a piece which is generally U-shaped in plan view (so as to define a central recess) and has dimensions as follows:

a =75 mm b =72.5 mm c =5 mm

The following Examples illustrate the process of the invention, and were carried out using apparatus as shown in FIG. 1 with a fluidisation unit supplied by the Nordson Corporation having a generally cylindrical vessel (1) of height 25 cm and diameter 15 cm.

In each Example, the workpiece (6) was connected to the direct-current supply cable (8) by means of a crocodile clip (10)—FIG. 2—mounted on an insulating support (7) in the form of a rod of length 300 mm. The workpiece was positioned centrally within the fluidising unit, giving rise to a minimum spacing of about 3.8 cm between the workpiece and the wall of the fluidising unit and resulting in a maximum potential gradient of about 0.79 kV/cm between the workpiece and the fluidising unit, when a voltage of 3 kV is applied to the workpiece. That is, satisfactory results are obtained for a maximum potential gradient that is expected to be no more than 1 kV/cm. It will be evident that the workpiece would need to be at a minimum distance of 0.1 cm from the wall of the fluidising unit in order for the maximum potential gradient to be 30 kV/cm when a voltage of 3 kV (the maximum used) is applied to the workpiece. The maximum potential gradient at 0.5 kV, the lowest voltage used, is about 0.13 kv/cm. and, as for some of the examples below, the lowest voltage may be 0.2 kV giving a maximum potential gradient of about 0.05 kv/cm. Allowing for the oscillation or the vibration of the workpiece, it is expected that satisfactory results would be obtained in conditions providing maximum potential gradients in the range 0.05 kV/cm to 1 kV/cm, probably 0.05 kV/cm to 5 kV/cm and, possibly, 0.05 kV/cm to 10 kV/cm.

Unless otherwise stated, the fluidising air pressure was 1 bar in each case.

The standard bake and cure of the deposited material in each Example comprised heating at 200° C. for 5 minutes.

The particle size data reported in the Examples was determined using the Mastersizer X laser light-scattering device manufactured by Malvern Instruments.

The data is expressed in volume percentiles d(v)X, where X is the percentage of the total volume of the particles that lies below the stated particle size d. Thus, for instance, $d(v)_{50}$ is the median particle size of the sample. Data relating to the deposited material (before bake and cure) was obtained by scraping the adhering deposit off the workpiece and into the Mastersizer.

All dip times reported in the Examples are in seconds.

EXAMPLE 1

The powder coating composition used in this Example as a white epoxy polyester hybrid powder designed for corona application and formulated as follows:

| | Parts by weight |
|---|---|
| Rutile Titanium Dioxide | 321 |
| Filler (dolomite) | 107 |
| Carboxylic Acid-Functional Polyester Resin | 374 |
| Epoxy Resin Curing Agent | 152 |
| Catalyst | 30 |
| Wax | 3 |
| Flow Modifier | 10 |
| Benzoin | 3 |
| | 1000 |

The ingredients were dry mixed in a blender, and fed into a twin-screw extruder operating at a temperature of 108° C.

The extrudate was ground in an impact mill to produce a powder with the following particle size distribution:

| | | |
|---|---|---|
| $d(v)_{99}$ | | 106.11 microns |
| $d(v)_{50}$ | | 41.45 microns |
| 6.31% | < | 10 microns |
| 2.04% | < | 5 microns |

Before fluidisation, the composition was blended with a 0.1% by weight addition of a synthetic silica flatting (matting) agent (fumed silica TS 100 ex-Degussa).

Before immersion of the workpiece, the blended composition was allowed to fluidise for 30 minutes in order to reach an equilibrium state.

The workpiece was connected to the voltage source and then immersed in the equilibrated fluidised bed for a given "dip" time before being withdrawn from the bed. While immersed, the workpiece was slowly moved back and forth in a regular oscillatory manner. The process was repeated at different applied voltages and dip times.

Table 1 below summarises the characteristics of the finished coating after standard bake and cure, for various applied voltages and dip times.

TABLE 1

| Voltage | Dip | % Coverage on 5 mm Recessed Panel | | Film Thickness (μm) | | | Standard Deviation of Film Thickness |
|---|---|---|---|---|---|---|---|
| (Volts) | Time(s) | Outer | Inner | Max. | Min. | Mean | (μm) |
| 0 | 120 | 25 | 50 | 225 | 0 | 54 | 86 |
| 500 | 180 | 60 | 60 | 260 | 0 | 120 | 93 |
| 1000 | 180 | 75 | 20 | 387 | 6 | 194 | 104 |
| 1300 | 240 | 100 | 70 | 270 | 102 | 204 | 50 |
| 2000 | 60 | 90 | 45 | 288 | 8 | 198 | 84 |
| 2500 | 30 | 65 | 15 | 299 | 0 | 197 | 131 |
| 3000 | 30 | 45 | 20 | 400 | 0 | 211 | 163 |

Figure 3:
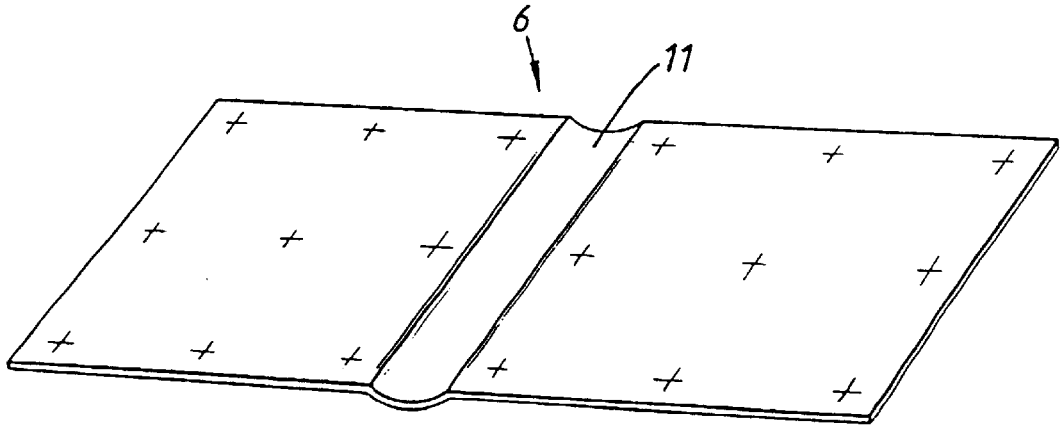
FIG. 3 is a perspective view of the workpiece of FIG. 2 in flattened-out condition for the purpose of evaluating film thickness and % coverage.

In order to obtain the data relating to % coverage and film thickness, the U-shaped (recessed) panel (6) was first flattened out as far as practicable into generally rectangular form as shown in FIG. 3. The central portion (11) retained some recessed character because of the difficulty of achieving an uninterrupted planar form without damaging the applied coating during the unfolding procedure.

Film thickness measurements were then taken at each of the points marked 'X' in FIG. 3 on both the obverse and the reverse of the flattened panel, giving a total of 18 readings for each face (corresponding to the "outer" and "inner" faces of the workpiece in the folded condition (FIG. 2), and 36 readings in all.

The figure given in the Table for maximum film thickness in each experiment is the highest of the 36 readings, and the figure given for minimum film thickness is the lowest of the readings. The quoted mean figure is the arithmetic mean of the 36 readings and the standard deviation is derived for each experiment from the 36 readings obtained as described.

The % coverage of each face was assessed visually.

The same procedures were used to obtain film thickness and % coverage data in each of the other Examples utilising U-shaped (recessed) workpieces, and analogous procedures were used in the case of the Examples using planar workpieces.

It will be seen from Table 1 that the optimum results were achieved with an applied voltage of 1.3 kV and a dip time of 240 seconds.

Figure 6:
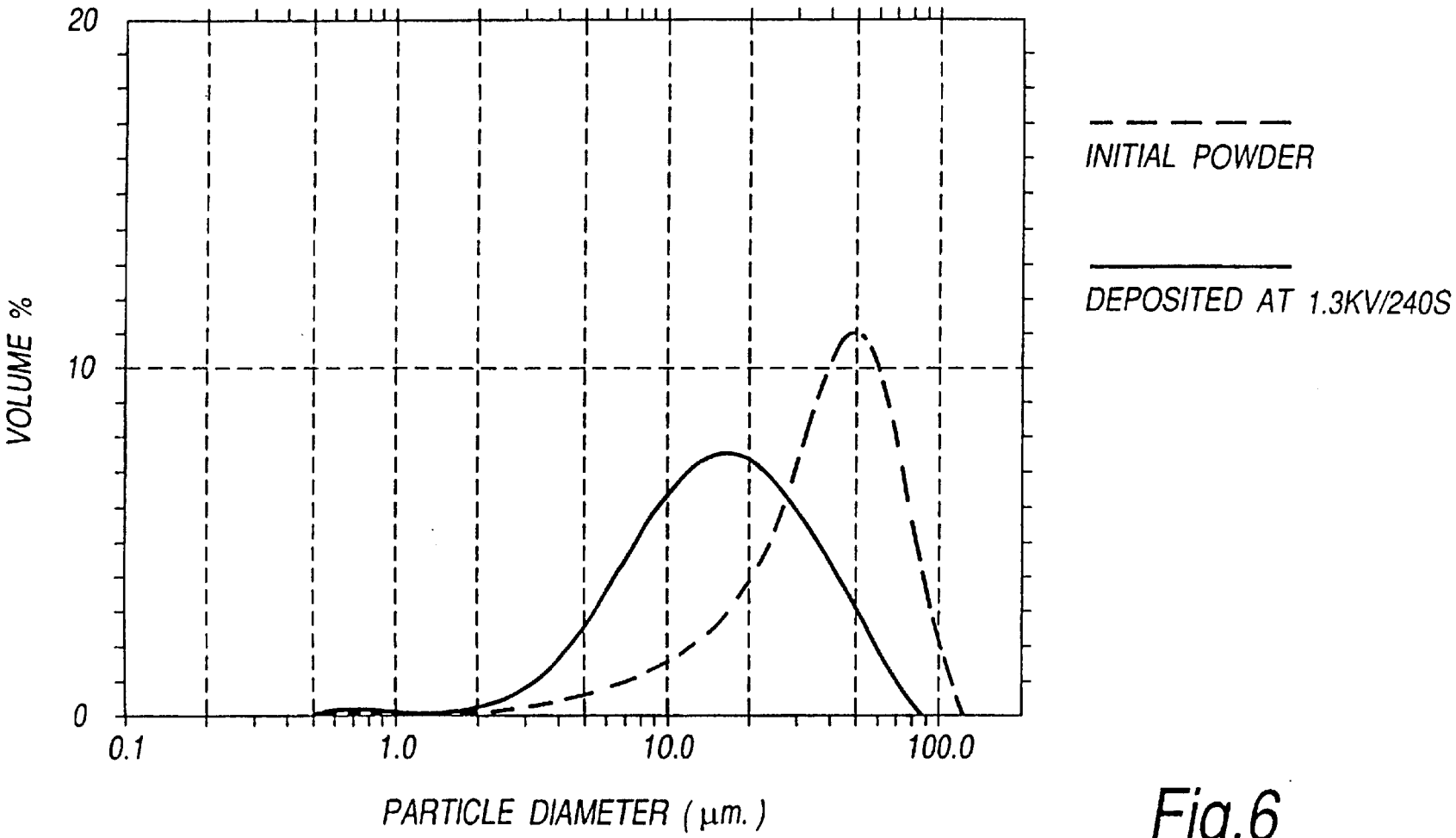

FIG. 6 shows the particle size distribution of the material deposited on the workpiece in Example 1, as a function of deposition voltage and dip time, as compared with the particle size distribution of the initial powder coating composition. It will be seen that the finer particles are deposited preferentially, leading to progressive depletion of those particle sizes in the fluidised bed.

The particle size distribution of the deposited material may be summarised as follows:

| | | |
|---|---|---|
| $d(v)_{99}$ | | 67.55 microns |
| $d(v)_{50}$ | | 15.54 microns |
| 29.58% | < | 10 microns |
| 8.67% | < | 5 microns |

EXAMPLE 2

The powder coating composition used in this Example was a white hybrid powder designed for tribostatic application, and formulated as follows:

| | Parts by weight |
|---|---|
| Rutile Titanium Dioxide | 252 |
| Filler (Calcium Carbonate) | 140 |
| Carboxylic Acid-Functional Polyester Resin (Uralac P5261 ex.DSM) | 360 |
| Epoxy Resin | 230 |
| Flow Modifier | 10 |
| Wax | 5 |
| Benzoin | 3 |
| | 1000 |

The ingredients were dry mixed in a blender, and fed into a twin-screw extruder operating at a temperature of 108° C. The extrudate was ground in an impact mill to produce a powder with the following particle distribution:

| | | |
|---|---|---|
| $d(v)_{99}$ | | 118.84 microns |
| $d(v)_{50}$ | | 45.48 microns |
| 6.06% | < | 10 microns |
| 1.70% | < | 5 microns |

Before fluidisation, the composition was blended with a 0.1% addition of aluminium oxide.

The coating process was carried out as described in Example 1, except that the substrate was a planar, rectangular aluminium panel (100 mm×60 mm) and a constant dip time of 100 seconds was used.

Table 2 below summarises the characteristics of the finished coating after standard bake and cure as a function of the applied deposition voltage.

TABLE 2

| Voltage (Volts) | Dip Time(s) | % Coverage on (100 × 60) mm Flat Panel | Film Thickness (μm) Max. | Min. | Mean | Standard Deviation of Film Thickness (μm) |
|---|---|---|---|---|---|---|
| 0 | 150 | 25 | 62 | 0 | 41 | 12 |
| 500 | 150 | 60 | 109 | 0 | 73 | 26 |
| 750 | 150 | 95 | 109 | 21 | 61 | 24 |
| 1000 | 150 | 100 | 155 | 30 | 84 | 40 |
| 1500 | 150 | 100 | 225 | 75 | 130 | 47 |

It will be seen that the thickness of the applied coating increases with increasing deposition voltage.

FIG. 7.1 shows the particle size distribution of the material deposited on the workpiece in Example 2 as a function of the deposition voltage at constant dip time (150 seconds). The finer particles are deposited preferentially, with the maximum deposition being of particles of around 20 microns in diameter, and it will be seen that the deposited distribution curve is not much affected by changes in the deposition voltage.

A further series of experiments was conducted at constant deposition voltage (1 kV) but at varying dip times. The results were similar to those shown in FIG. 7.1, i.e., the finer particles are deposited preferentially with a peak at around 20 microns, and the deposited distributions were substantially independent of the dip time:

FIG. 7.2 shows the particle size distribution of the material deposited on the workpiece with a dip time of 60 seconds, as compared with the particle size distribution of the initial powder coating composition. The results for dip times of 30 seconds, 90 seconds and 120 seconds (not shown in FIG. 7.2) were almost identical.

EXAMPLE 3

The powder coating composition used in this Example was a brown polyester/TGIC powder designed for corona application and formulated as follows:

| | Parts by weight |
|---|---|
| Rutile Titanium Dioxide | 6 |
| Red Iron Oxide | 27 |
| Yellow Lead Chromate | 35 |
| Lamp Black 101 Fluffy | 12 |
| Filler (Barium Sulphate) | 207 |
| Carboxylic Acid-Functional Polyester Resin | 650 |
| TGIC | 48 |
| Flow Modifier | 10 |
| Wax | 2 |
| Benzoin | 3 |
| | 991 |

The ingredients were dry mixed in a blender and fed into a twin-screw extruder operating at a temperature of 130° C. The extrudate was ground in an impact mill to produce a powder with the following particle size distribution:

| | | |
|---|---|---|
| $d(v)_{99}$ | | 101.94 microns |
| $d(v)_{50}$ | | 37.62 microns |
| 10.51% | < | 10 microns |
| 3.98% | < | 5 microns |

Before fluidisation, the composition was blended with a 0.1% by weight addition of a silica flatting (matting) agent.

The coating process was carried out as described in Example 1, with a workpiece as shown in FIG. 2, except that a constant dip time of 240 seconds was used, and the applied voltage was negative rather than positive.

Table 3 below summarises the characteristics of the finished coating after standard bake and cure as a function of the applied deposition voltage:

TABLE 3

| Voltage (Volts) | | % Coverage on Recessed Panel | | Film Thickness (μm) | | | Standard Deviation of Film Thickness |
|---|---|---|---|---|---|---|---|
| −VE | Time(s) | Outer | Inner | Max. | Min. | Mean | (μm) |
| 500 | 240 | 0 | 0 | 0 | 0 | 0 | 0 |
| 1000 | 240 | 75 | 55 | 37 | 0 | 23 | 13 |
| 1500 | 240 | 100 | 80 | 65 | 0 | 44 | 15 |
| 2000 | 240 | 100 | 100 | 100 | 55 | 69 | 11 |

Figure 8:
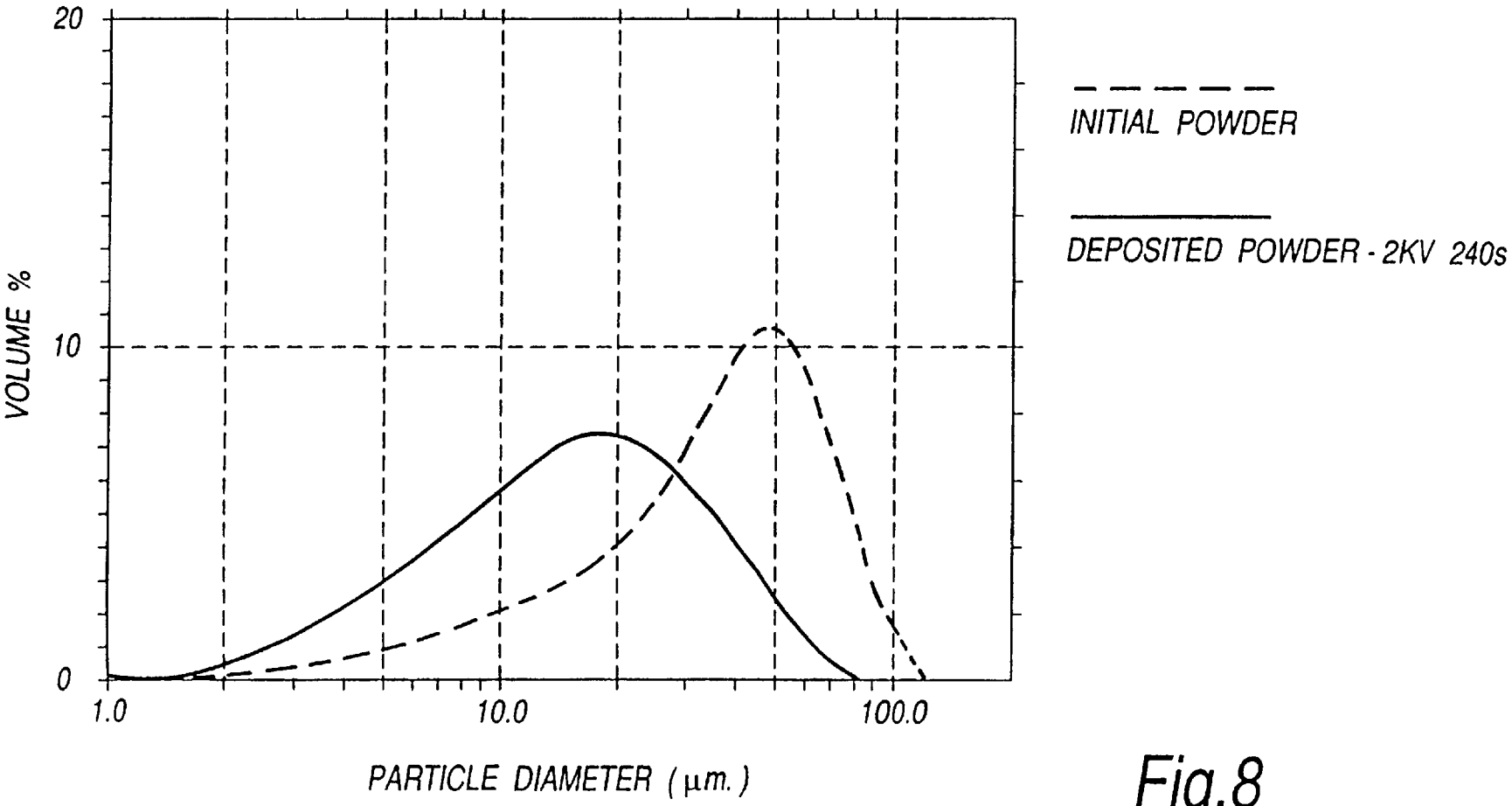

FIG. 8 shows the particle size distribution of the material deposited on the workpiece in Example 3 at a deposition voltage of −2 kV.

The particle size distribution of the deposited material may be summarised as follows:

| | | |
|---|---|---|
| $d(v)_{99}$ | | 63.43 microns |
| $d(v)_{50}$ | | 15.13 microns |
| 32.10% | < | 10 microns |
| 12.42% | < | 5 microns |

EXAMPLE 4

The powder coating composition used in this Example was a white epoxy/polyester hybrid formulated as follows:

| | Parts by weight |
|---|---|
| Rutile Titanium Dioxide | 352 |
| Carboxylic Acid-Functional Polyester Resin | 317 |
| Epoxy Resin | 314 |
| Flow Modifier | 10 |
| Catalyst | 1 |
| Benzoin | 3 |
| Wax | 3 |
| | 996 |

The ingredients were dry mixed in a blender and fed into a twin-screw extruder operating at a temperature of 108° C. The extrudate was ground in an impact mill to produce a powder with the following particle size distribution:

| | | |
|---|---|---|
| $d(v)_{99}$ | | 59.74 microns |
| $d(v)_{50}$ | | 21.61 microns |
| 16.58% | < | 10 microns |
| 5.19% | < | 5 microns |

Before fluidisation, the composition was blended with 0.75% by weight of a dry flow additive comprising alumina and aluminium hydroxide (45% :55% by weight).

The coating process was carried out as described in Example 1, with a workpiece as shown in FIG. 2, except that a constant dip time of 150 seconds was used.

Table 4 below summarises the characteristics of the finished coating after standard bake and cure as a function of the applied deposition voltage.

TABLE 4

| Voltage | | % Coverage on 5 mm recessed panel | | Film Thickness (μm) | | | Standard Deviation of Film Thickness |
|---|---|---|---|---|---|---|---|
| (Volts) | Time(s) | Outer | Inner | Max. | Min. | Mean | (μm) |
| 0 | 150 | 50 | 90 | 23 | 0 | 10 | 4 |
| 200 | 150 | 60 | 90 | 24 | 0 | 11 | 4 |
| 400 | 150 | 95 | 95 | 27 | 0 | 15 | 5 |
| 600 | 150 | 98 | 99 | 36 | 0 | 25 | 6 |
| 800 | 150 | 100 | 98 | 47 | 0 | 35 | 7 |
| 1000 | 150 | 100 | 100 | 63 | 19 | 43 | 8 |

Figure 9:
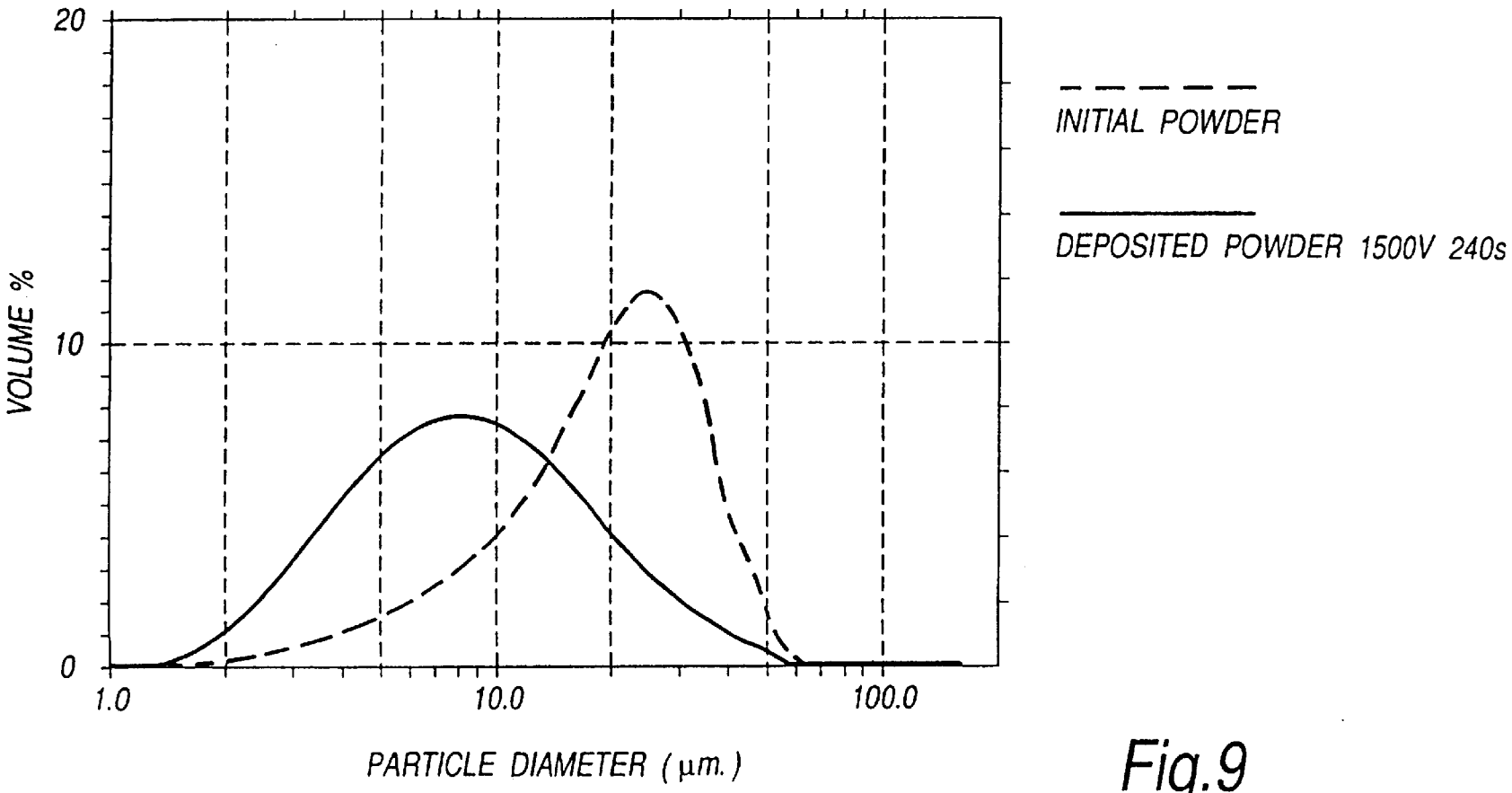

FIG. 9 below shows the particle size distribution of the material deposited on the workpiece in Example 4 at 1 kV, as compared with the particle size distribution of the initial coating composition.

The particle size distribution of the deposited material may be summarised as follows:

| | | |
|---|---|---|
| $d(v)_{99}$ | | 43.15 microns |
| $d(v)_{50}$ | | 8.08 microns |
| 60.60% | < | 10 microns |
| 26.99% | < | 5 microns |

The results show improved coating performance as compared with the previous Example, and also that, with the finer initial distribution, the preferential deposition of finer particles (peaking at around 20 microns) leads to less differential depletion of the size distribution of the initial composition.

EXAMPLE 5

The powder coating composition used in this Example was the same as that used in Example 4, except that the dry flow additive comprising alumina and aluminium hydroxide (45:55 w/w) was incorporated in an amount of 0.3% by weight instead of 0.75% by weight.

The coating process was carried out as described in Example 1, with a workpiece as shown in FIG. 2, except that a constant voltage of 1 kV was used and the fluidising air pressure was 2 bar.

Table 5 below summarises the characteristics of the finished coating after standard bake and cure as a function of the dip time.

TABLE 5

| Voltage | | % Coverage on 5 mm recessed panel | | Film Thickness (μm) | | | Standard Deviation of Film Thickness |
|---|---|---|---|---|---|---|---|
| (Volts) | Time(s) | Outer | Inner | Max. | Min. | Mean | (μm) |
| 1000 | 150 | 100 | 95 | 29 | 3 | 21 | 7 |
| 1000 | 240 | 100 | 100 | 33 | 21 | 27 | 4 |
| 1000 | 360 | 100 | 100 | 31 | 18 | 23 | 4 |

Figure 10:
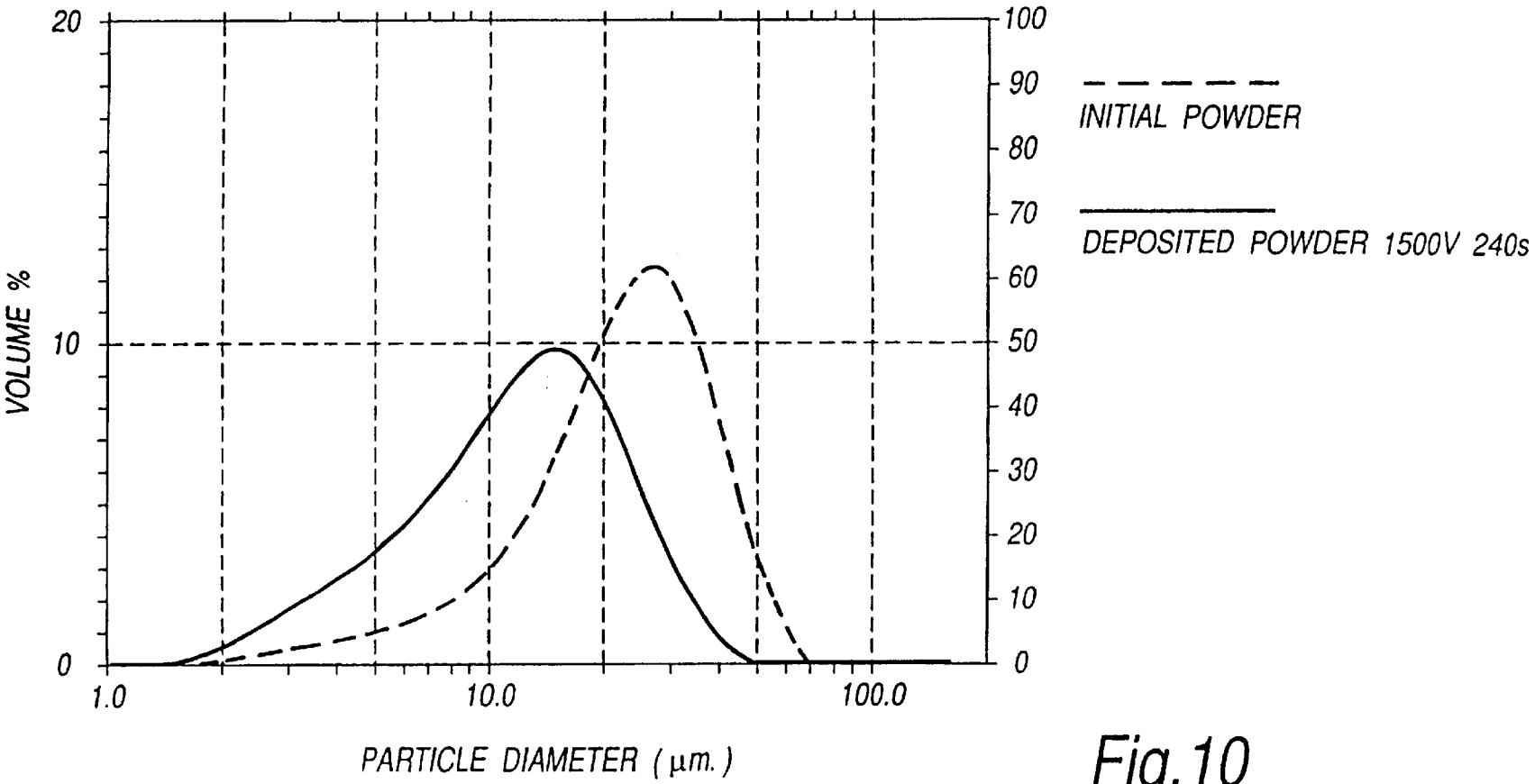

FIG. 10 shows the particle size distribution of the material deposited on the workpiece in Example 5 at 360 seconds, as compared with the particle size distribution of the initial coating composition.

The particle size distribution of the deposited material may be summarised as follows:

| | |
|---|---|
| $d(v)_{99}$ | 37.44 microns |
| $d(v)_{50}$ | 12.23 microns |
| 38.65% | <10 microns |
| 14.02% | <5 microns |

EXAMPLE 6

The powder coating composition used in this example was the same as that used in Example 4, except that the composition was blended with 0.3% by weight of aluminium oxide C instead of the aluminium oxide/aluminium hydroxide additive.

The coating process was carried out as described in Example 1, with a workpiece as shown in FIG. 2, except that the fluidising air pressure was 2 bar.

Table 6 below summarises the characteristics of the finished coating after standard bake and cure.

TABLE 6

| Voltage | | % Coverage on 5 mm recessed panel | | Film Thickness (μm) | | | Standard Deviation of Film Thickness |
|---|---|---|---|---|---|---|---|
| (Volts) | Time(s) | Outer | Inner | Max. | Min. | Mean | (μm) |
| 600 | 360 | 100 | 100 | 40 | 25 | 32 | 5 |
| 700 | 240 | 100 | 98 | 44 | 16 | 32 | 7 |
| 700 | 360 | 100 | 100 | 42 | 20 | 35 | 6 |

Figure 11:
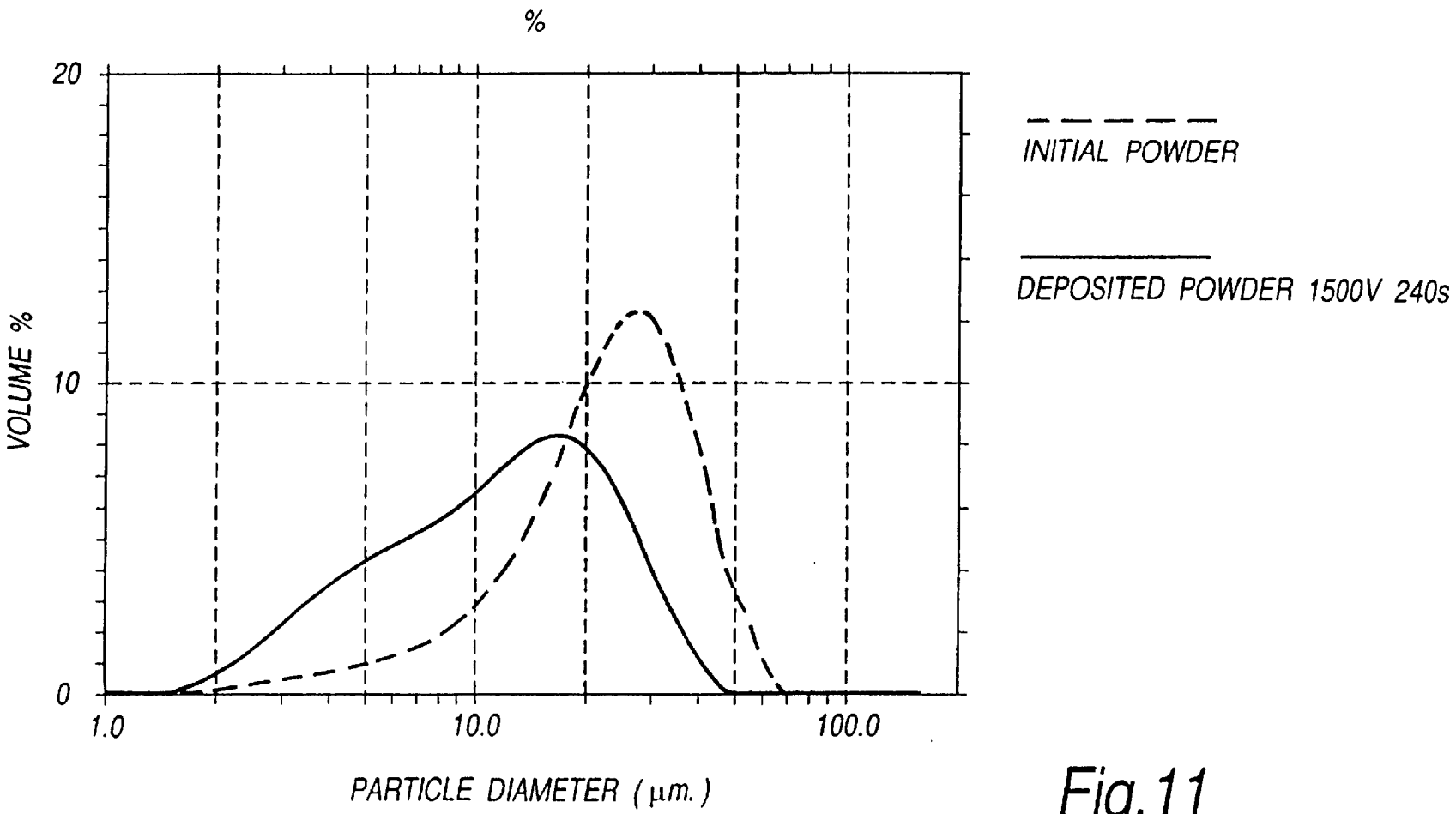

FIG. 11 shows the particle size distribution of the material deposited on the workpiece in Example 6 at 360 seconds, as compared with the particle size distribution of the initial coating composition.

The particle size distribution of the deposited material may be summarised as follows:

| | |
|---|---|
| $d(v)_{99}$ | 38.94 microns |
| $d(v)_{50}$ | 11.65 microns |
| 43.05% | <10 microns |
| 18.52% | <5 microns |

EXAMPLE 7

The powder coating composition used in this Example was the same as that used in Example 4, except that the composition was blended with 0.3% by weight of silica instead of the aluminium oxide/aluminium hydroxide additive.

The coating process was carried out as described in Example 1, with a workpiece as shown in FIG. 2, except that negative voltages were applied to the workpiece and the fluidising air pressure was 2 bar.

Table 7 below summarises the characteristics of the finished coating after standard bake and cure.

TABLE 7

| Voltage (Volts) | | % Coverage on 5 mm recessed panel | | Film Thickness (μm) | | | Standard Deviation of Film Thickness |
|---|---|---|---|---|---|---|---|
| −VE | Time(s) | Outer | Inner | Max. | Min. | Mean | (μm) |
| 500 | 150 | 100 | 60 | 14 | 0 | 8 | 3 |
| 1000 | 150 | 100 | 70 | 23 | 0 | 12 | 4 |
| 1250 | 150 | 100 | 95 | 40 | 0 | 21 | 11 |
| 1250 | 480 | 100 | 98 | 26 | 0 | 16 | 4 |
| 1500 | 150 | 100 | 70 | 31 | 0 | 18 | 5 |
| 2000 | 150 | 100 | 80 | 58 | 0 | 33 | 7 |
| 2500 | 150 | 100 | 95 | 55 | 0 | 35 | 8 |

Figure 12:
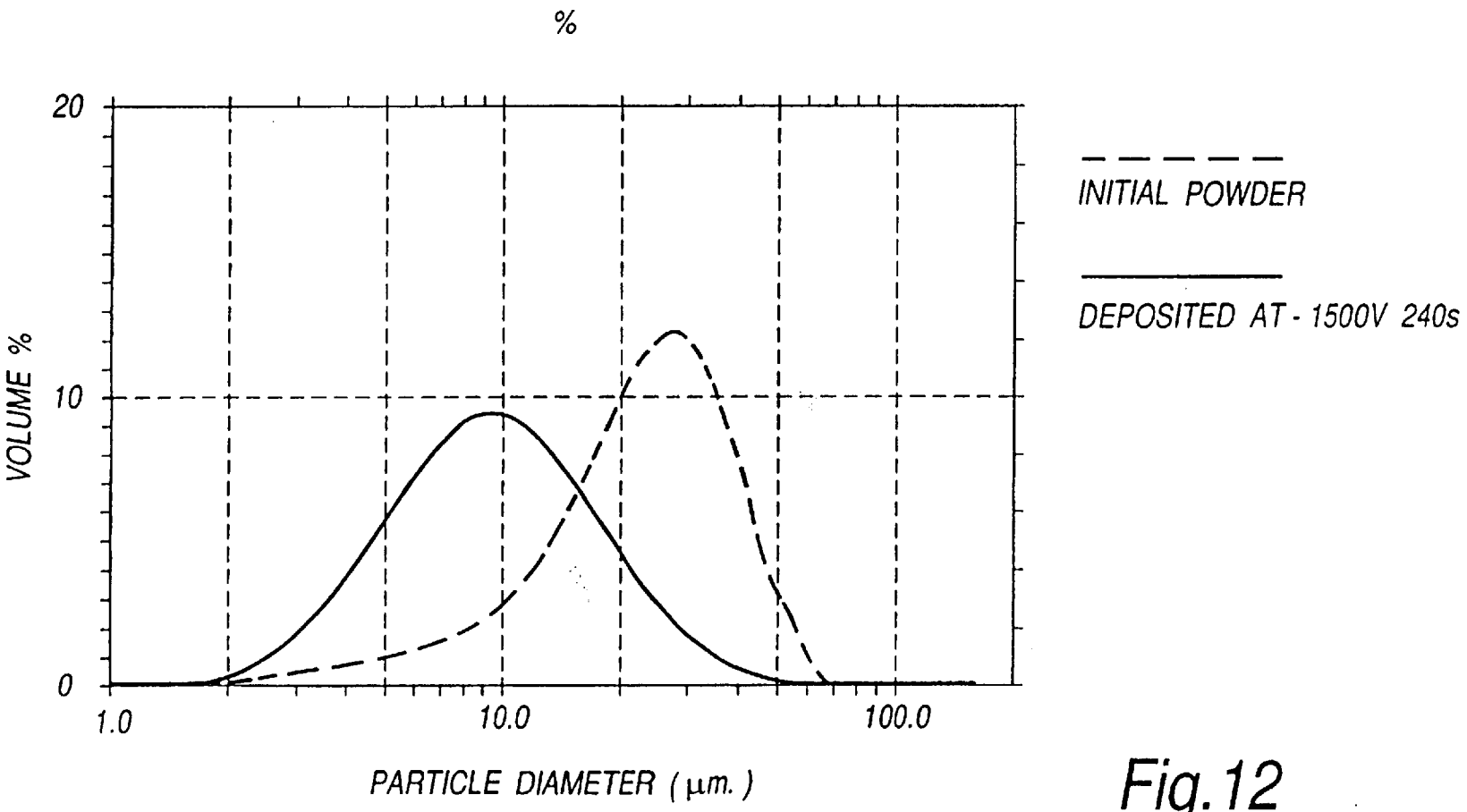

FIG. 12 shows the particle size distribution of the material deposited on the workpiece in Example 7 at −1.5 kV and 150 seconds, as compared with the particle size distribution of the initial coating composition.

The particle size distribution of the deposited material may be summarised as follows:

| | |
|---|---|
| $d(v)_{99}$ | 37.64 microns |
| $d(v)_{50}$ | 9.13 microns |
| 55.62% | <10 microns |
| 17.58% | <5 microns |

EXAMPLE 8

The powder coating composition used in this Example was a grey epoxy/dicyandiamide powder formulated as follows:

| | Parts by weight |
|---|---|
| Rutile Titanium Dioxide | 204 |
| Heucosin Fast Blue | 5 |
| Lamp Black 101 Fluffy | 2 |
| Filler (Dolomite) | 63 |
| Filler (Barium Sulphate) | 84 |
| Epoxy Resin | 600 |
| Epicure P-104 (ex. Shell Chemicals) | 8 |
| Benzoin | 3 |
| | 1000 |

The ingredients were dry mixed in a blender, and fed into a twin-screw extruder operating at a temperature of 90° C. The extrudate was ground in an impact mill to produce a powder with the following particle size distribution:

| | |
|---|---|
| $d(v)_{99}$ | 68.57 microns |
| $d(v)_{50}$ | 22.67 microns |
| 14.68% | <10 microns |
| 5.23% | <5 microns |

Before fluidisation, the composition was blended with 0.75% by weight of an additive comprising aluminium oxide and aluminium hydroxide (45:55 w/w).

The coating process was carried out as described in Example 1, with a workpiece as shown in FIG. 2, but with negative applied voltages and varying the fluidising air pressure.

Table 8 below summarises the characteristics of the finished coating after standard bake and cure.

TABLE 8

| Air Pressure (bar) | Voltage (Volts) −VE | Time(s) | % Coverage on 5 mm recess panel Outer | Inner | Film Thickness (μm) Max. | Min. | Mean | Standard Deviation of Film Thickness (μm) |
|---|---|---|---|---|---|---|---|---|
| 1 | 1000 | 150 | 98 | 80 | 23 | 0 | 11 | 5 |
| | 1500 | 150 | 100 | 50 | 57 | 0 | 17 | 11 |
| | 1000 | 240 | 100 | 100 | 28 | 3 | 13 | 6 |
| | 1500 | 240 | 100 | 95 | 65 | 0 | 19 | 10 |
| | 2000 | 150 | 100 | 100 | 68 | 4 | 22 | 12 |
| | 2000 | 240 | 100 | 100 | 83 | 4 | 24 | 17 |
| 2 | 1000 | 150 | 100 | 99 | 14 | 0 | 9 | 3 |
| | 1000 | 240 | 100 | 95 | 14 | 0 | 10 | 2 |
| | 1500 | 150 | 100 | 95 | 17 | 0 | 12 | 4 |
| | 1500 | 240 | 100 | 100 | 22 | 2 | 12 | 4 |
| | 2000 | 150 | 100 | 95 | 40 | 0 | 22 | 9 |
| | 2000 | 240 | 100 | 98 | 49 | 0 | 22 | 9 |
| 3 | 1000 | 150 | 100 | 60 | 15 | 0 | 12 | 4 |
| | 1000 | 240 | 100 | 50 | 13 | 0 | 9 | 3 |
| | 1500 | 150 | 100 | 75 | 25 | 0 | 16 | 6 |
| | 1500 | 240 | 100 | 80 | 23 | 0 | 16 | 6 |
| | 2000 | 240 | 100 | 100 | 38 | 8 | 24 | 6 |

It will be seen that relatively thin films were achievable in this Example.

The particle size distribution of the deposited material may be summarised as follows:

| | |
|---|---|
| $d(v)_{99}$ | 44.65 microns |
| $d(v)_{50}$ | 10.66 microns |
| 45.96% | <10 microns |
| 13.08% | <5 microns |

EXAMPLE 9

The powder coating composition used in this Example was a green polyester/primid powder formulated as follows:

| | Parts by weight |
|---|---|
| Yellow Iron Oxide | 16 |
| Lamp Black 101 Fluffy | 1 |
| Monastral Green | 19 |
| Rutile Titanium Dioxide | 7 |
| Carboxylic Acid-Functional Polyester Resin | 570 |

-continued

| | Parts by weight |
|---|---|
| Primid XL552 (ex. EMS) | 30 |
| Filler | 341 |
| Benzoin | 3 |
| Flow Modifier | 10 |
| Wax | 3 |
| | 993 |

The ingredients were dry mixed in a blender and fed into a twin-screw extruder operating at a temperature of 130° C.

The extrudate was ground in an impact mill to produce a powder with the following particle size distribution:

| | |
|---|---|
| $d(v)_{99}$ | 78.7 microns |
| $d(v)_{50}$ | 26.26 microns |
| 12.77% | <10 microns |
| 5.21% | <5 microns |

Before fluidisation, the composition was blended with 0.3% by weight of an additive comprising aluminium oxide and aluminium hydroxide (45:55 w/w).

The coating process was carried out as described in Example 1, except that the substrate was a planar, rectangular aluminium panel (100 mm×50 mm), a constant dip time of 150 seconds was used, and the applied voltage was varied from +1 kV to −1 kV.

Table 9 below summarises the characteristics of the finished coating after standard bake and cure.

TABLE 9

| Voltage (Volts) | Time(s) | % Coverage on Flat (100 × 50)mm Panel | Film Thickness (μm) Max. | Min. | Mean | Standard Deviation of Film Thickness (μm) |
|---|---|---|---|---|---|---|
| 0 | 150 | 10 | 14 | 0 | 5 | 4 |
| 200 | 150 | 70 | 17 | 0 | 9 | 5 |
| 400 | 150 | 100 | 30 | 6 | 18 | 6 |
| 600 | 150 | 100 | 38 | 24 | 31 | 4 |
| 800 | 150 | 100 | 48 | 35 | 41 | 4 |
| 1000 | 150 | 100 | 51 | 41 | 45 | 4 |
| −200 | 150 | 60 | 40 | 0 | 16 | 13 |
| −400 | 150 | 75 | 38 | 0 | 19 | 13 |
| −600 | 150 | 99 | 47 | 13 | 29 | 10 |
| −800 | 150 | 100 | 49 | 31 | 37 | 6 |
| −1000 | 150 | 100 | 59 | 38 | 45 | 8 |

The particle size distribution of the deposited material may be summarised as follows:

| | |
|---|---|
| $d(v)_{99}$ | 44.34 microns |
| $d(v)_{50}$ | 16.61 microns |
| 21.85% | <10 microns |
| 7.91% | <5 microns |

The powder coating composition used in this Example was a white hybrid powder formulated as follows:

| | Parts by weight |
|---|---|
| Rutile Titanium Dioxide | 398 |
| Carboxylic Acid-Functional Polyester Resin | 343 |
| Epoxy Resin | 233 |
| Flow Modifier | 10 |
| Benzoin | 3 |
| Wax | 3 |
| | 990 |

The ingredients were dry mixed in a blender and fed into a twin-screw extruder at a temperature of 108° C. The extrudate was ground in an impact mill to produce a powder with the following particle size distribution:

| | |
|---|---|
| $d(v)_{99}$ | 89.56 microns |
| $d(v)_{50}$ | 32.58 microns |
| 7.95% | <10 microns |
| 2.56% | <5 microns |

Before fluidisation, the composition was blended with 0.75% by weight of an additive comprising aluminium oxide and aluminium hydroxide (45:55 w/w).

The coating process was carried out as described in Example 1, except that the substrate was a planar, rectangular steel panel (150 mm×100 mm) pre-treated with zinc phosphate, a constant dip time of 150 seconds was used, and negative voltages were applied to the substrate.

Table 10 below summarises the characteristics of the finished coating after standard bake and cure.

TABLE 10

| Voltage (Volts) | | % Coverage on Flat (150 × 100)mm | Film Thickness (μm) | | | Standard Deviation of Film Thickness |
|---|---|---|---|---|---|---|
| −VE | Time(s) | Panel | Max. | Min. | Mean | (μm) |
| 500 | 150 | 100 | 33 | 9 | 21 | 8 |
| 750 | 150 | 100 | 34 | 7 | 20 | 8 |
| 1000 | 150 | 100 | 41 | 7 | 24 | 9 |
| 1250 | 480 | 100 | 41 | 6 | 24 | 9 |
| 1500 | 150 | 100 | 42 | 10 | 26 | 9 |
| 1750 | 150 | 100 | 64 | 27 | 39 | 11 |
| 2000 | 150 | 100 | 101 | 20 | 44 | 21 |

The particle size distribution of the deposited material may be summarised as follows:

| | |
|---|---|
| $d(v)_{99}$ | 51.81 microns |
| $d(v)_{50}$ | 13.40 microns |
| 33.97% | <10 microns |
| 10.63% | <5 microns |

As is explained above in relation to Example 1, when 3 kV is applied to the workpiece the maximum potential gradient in the fluidising gas is likely to be about 0.79 kV/cm and, for the voltage range of 0.2 kV to 3 kV used in the above Examples, the maximum potential gradient present in any of the Examples is expected to be within the range 0.05 kV/cm to 10 kV/cm.

EXAMPLE 11

The powder coating composition used in this Example was the same as that used in Example 10.

Figure 4:
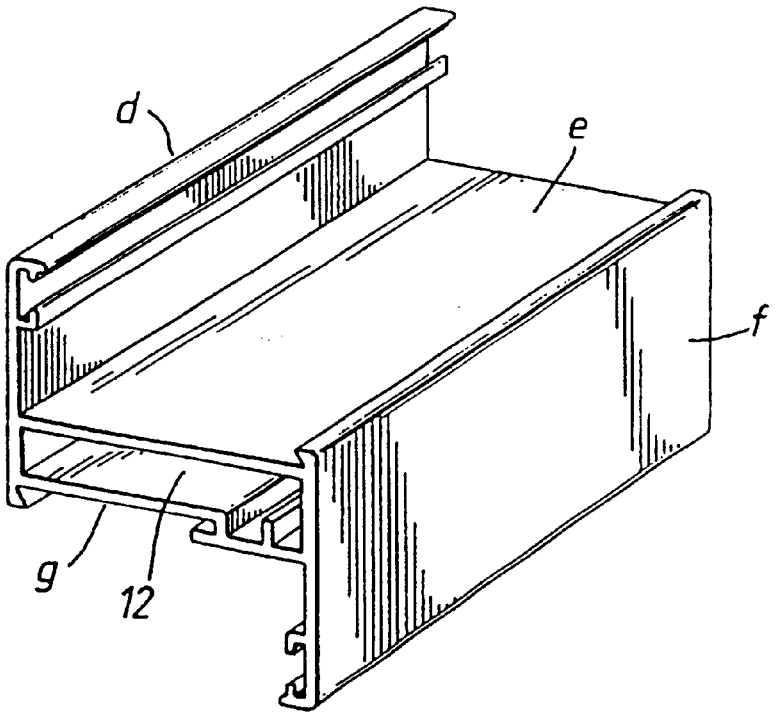
FIG. 4 is a perspective view of the workpiece used in Example 11.
Figure 5:
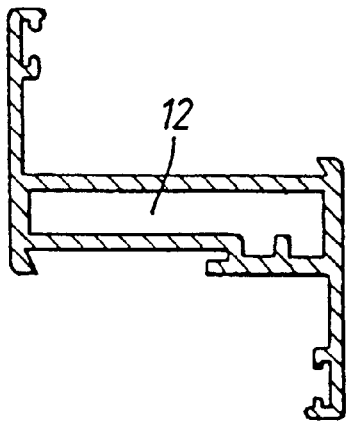
FIG. 5 is a sectional view of the workpiece of FIG. 4.

The substrate was an aluminium extrusion as shown in FIGS. 4 and 5. The dimensions of the faces designated d to g in FIG. 4 are as follows:

d :2.9 cm by 7.5 cm.

e :3.5 cm by 7.5 cm.

f :2.9 cm by 7.5 cm.

g :2.3 cm by 7.5 cm.

Considering the common dimension of 7.5 cm as the height of the substrate shown in FIGS. 4 and 5, the substrate would fit into a rectangular "tube" of height 7.5 cm, width 4.5 cm and depth 3.9 cm. When positioned centrally and upright in a Nordson Corporation cylindrical fluidisation unit of 15 cm diameter, the minimum spacing between the substrate and the wall of the fluidisation unit would be about 4.4 cm, resulting in a maximum potential gradient between the substrate and the fluidisation unit of about 0.23 kV/cm when the voltage applied to the substrate is 1 kV. Air serves as the fluidising gas and a maximum potential gradient of 0.23 kV/cm is well below the ionisation potential gradient of 30 kV/cm for air at atmospheric pressure. That is, the maximum potential gradient present in the apparatus used in the experiment is expected to lie below 1 kV/cm. When the voltage applied to the substrate is 1 kV, the substrate would need to come within 0.033 cm of the wall of the fluidisation unit for the maximum potential gradient to reach 30 kV/cm. Allowing for oscillation or vibration of the workpiece, it is expected that the conditions would result in maximum potential gradients in the range 0.05 kV/cm to 10 kV/cm, as stated above.

The coating process was carried out as described in Example 1 with a dip time of 150 seconds at 1 kV.

Approximately 100% coverage of the substrate was achieved after standard bake and cure (including coverage of the inner surfaces of the void (12) and of the various illustrated recesses) with film thickness as follows on the faces designated d to g:

| | |
|---|---|
| d | 51 microns |
| e | 42 microns |
| f | 47 microns |
| g | 53 microns |

Figure 13:
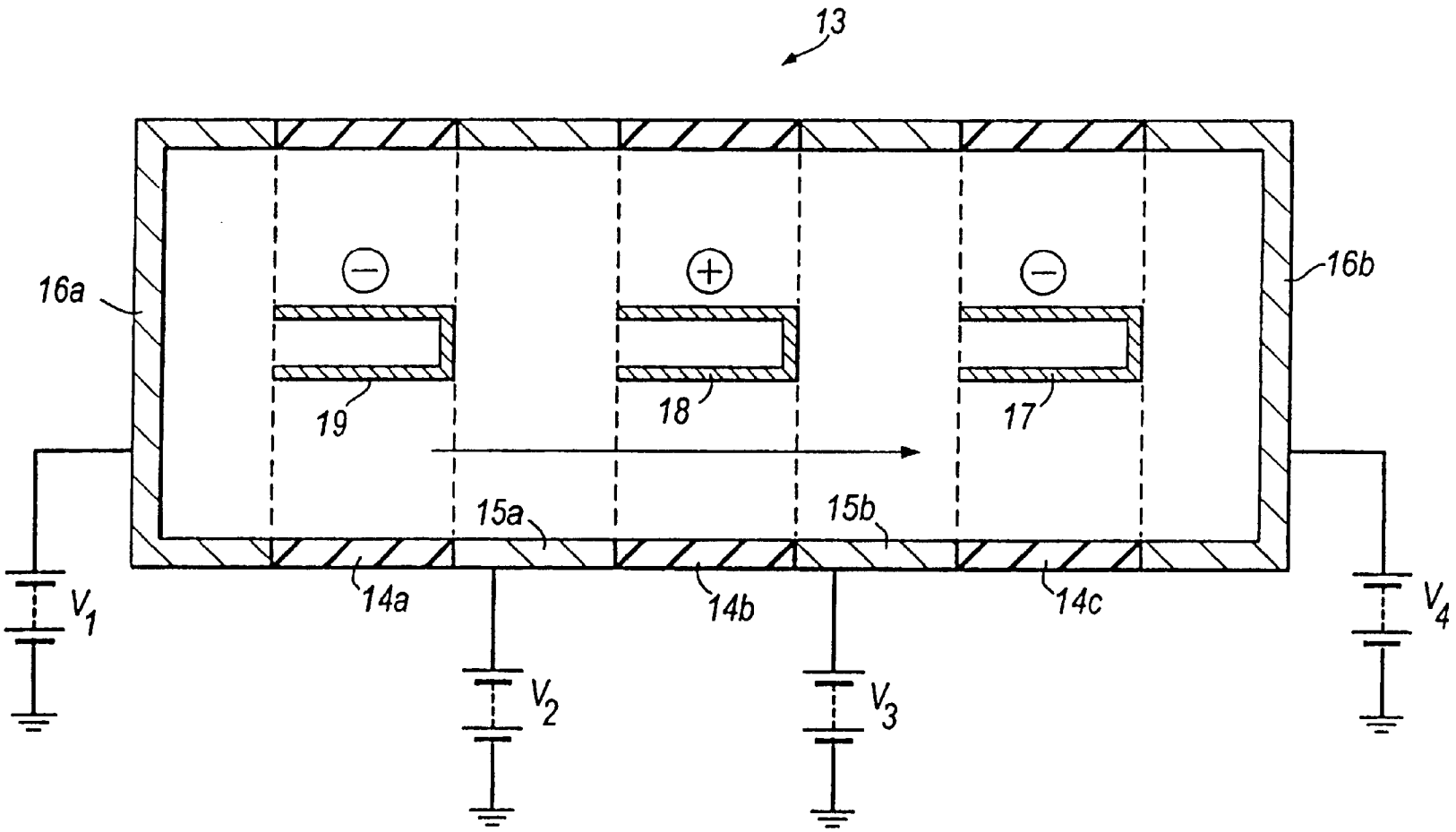
FIG. 13 is a diagrammatic plan view of the second form of fluidisaton and coating apparatus.

Referring to FIG. 13 of the accompanying drawings, the second form of fluidisation and coating apparatus comprises a fluidisation chamber indicated generally by the reference numeral (13) having walls composed alternately of insulating sections (14*a*, 14*b*, 14*c*) and conducting sections (15*a*, 15*b*). End sections (16*a*, 16*b*) of the fluidising chamber are also conducting. The conducting sections 16*a*, 15*a*, 15*b* and 16*b* are connected to respective voltage sources V1, V2, V3 and V4.

In operation, a fluidised-bed of a powder coating composition is established within the fluidisation chamber (13) and a series of workpieces (17,18,19) is immersed and transported through the bed in a direction shown (by means not shown). Each workpiece shown in FIG. 13 is of the form shown in FIG. 2, but the apparatus can in principle be used to coat articles of any desired shape.

For at least part of the period of immersion, the workpieces are electrically charged by means of direct voltages in such a way that the polarities of successive workpieces are in alternating sequence. The alternating polarities of the workpieces and the voltages applied to the conducting sections 15*a*, 15*b*, 16*a* and 16*b* of the wall of the fluidising chamber 13, along with the bipolar charging of the powder particles, result in the workpieces being subjected to a sequence of conditions as they pass through the fluidising chamber. The conducting sections 15*a*, 15*b*, 16*a* and 16*b* may, alternatively, be all connected to the earth terminal of the mains supply rather than to voltage sources.

Figure 14:
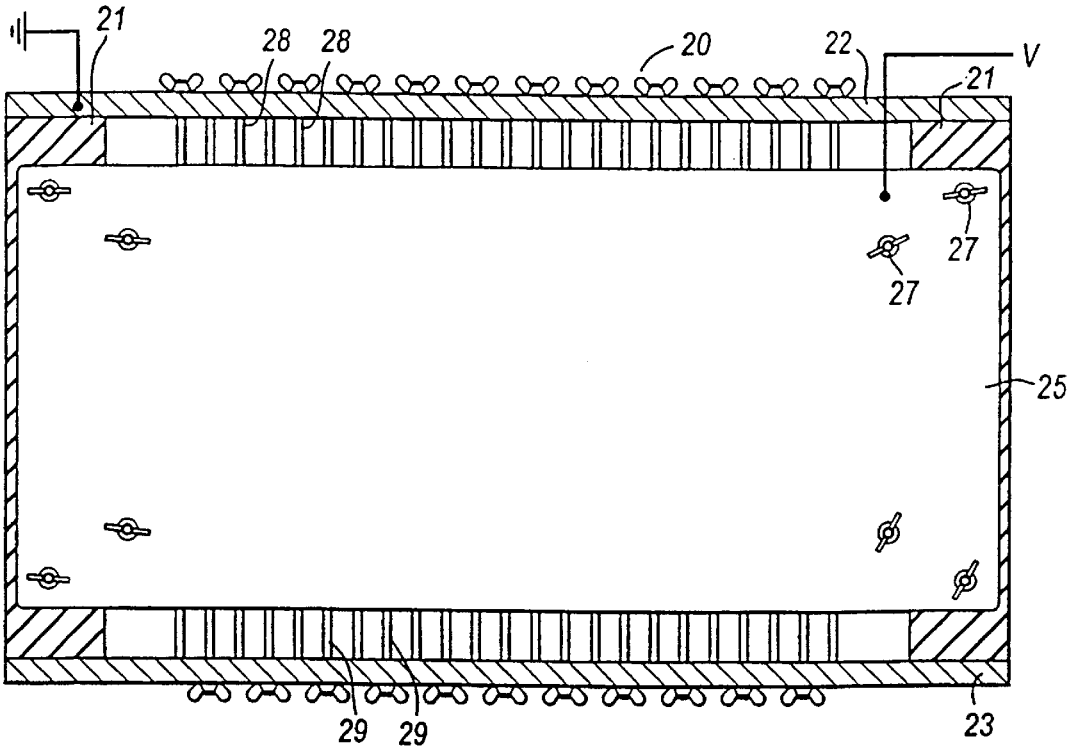
FIG. 14 is a diagrammatic front elevation view of an arrangement for coating a workpiece with recesses into which counter-electrodes have been inserted.
Figure 15:
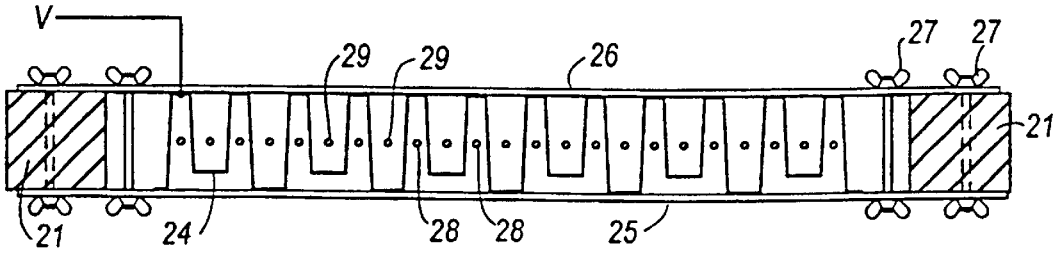
FIG. 15 is a diagrammatic plan view of the arrangement of FIG. 14.

Referring to FIGS. 14 and 15 of the accompanying drawings, an arrangement 20 used in carrying out Example 12, described below, includes side (as viewed) pillars 21 of electrically insulating material, upper and lower (as viewed) steel bars 22 and 23, a corrugated steel panel 24, a steel front (as viewed) plate 25, a steel rear (as viewed) plate 26, a plurality of securing bolts 27 holding the steel plates 25 and 26 firmly together with the corrugated steel panel 24 between the steel plates 25 and 26, a first plurality of steel rods 28 passing through front (as viewed) recesses of the corrugated steel panel 24 in addition to passing through apertures in the steel bars 22 and 23 and a second plurality of steel rods 29 passing through rear (as viewed) recesses of the corrugated steel panel 24 in addition to passing through apertures in the steel bars 22 and 23. The ends of the steel rods 28 and 29 are threaded and nuts screwed along the threaded ends of the steel rods 28 and 29 securing them to the upper and lower steel bars 22 and 23. The side pillars 21 are attached to the upper and lower steel bars 22 and 23, forming a rigid frame. The side pillars 21 are also securely clamped between the front and rear steel plates 25 and 26 by threaded bolts secured by nuts. The arrangement 20 is a rigid assembly in which the front plate 25, the rear plate 26 and the corrugated panel 24 form a first conductive sub-assembly while the upper bar 22, the lower bar 23 and the rods 28, 29 form a second sub-assembly. The first and second sub-assemblies are isolated electrically from each other by the non-conductive pillars 21 and no parts of the two sub-assemblies contact one another.

The corrugated panel 24 includes corrugations of a maximum depth of 4 cm and the dimensions of the panel 24 are 30 cm (length) by 18 cm (height). The corrugated panel 24 serves as the workpiece and the rods 28, 29 serve as counter-electrodes in Example 12 described below.

The arrangement 20 is 4 cm thick and its overall dimensions are 42 cm (length) by 24 cm (height). The front and rear plates 22 and 23 are each 18 cm high.

EXAMPLE 12

The powder coating composition used in this Example was a white epoxy/polyester hybrid formulated as in Example 4. The ingredients were dry mixed in a blender and fed into a twin screw extruder operating at a temperature of 108 C. The extrudate was ground in an impact mill to produce a powder with the following particle size distribution:

$d(v)_{99}$ =55 microns $d(v)_{50}$ =22 microns

16% <10 microns

5% <5 microns

Before fluidisation, the powder was blended with 0.6& by weight of a dry flow additive comprising alumina and aluminium hydroxide (45% :55% by weight).

The coating process was carried out as follows on the frame described above with reference to FIGS. 14 and 15:

A rectangular fluidising vessel of dimensions 80 cm (length) by 40 cm (width) by 50 cm (height) was filled to three-quarters of its height with the powder described above and the powder was fluidised using compressed air at a pressure of 4 bar. The panel 24 and the front and rear plates 25, 26 were connected to a positive voltage of 2 kV. The upper bar 22 was connected to the earth terminal of the mains supply, maintaining the upper bar 22, the lower bar 23 and the rods 28, 29 at earth relative to the panel 24 and the plates 25, 26.

The minimum distance between the rods 28, 29 and the panel was measured as 3 mm, giving a maximum potential gradient of 6.67 kV/cm between the charged and the earthed parts, well below the level of 30 kV/cm that would result in corona effect or ionisation in the fluidised bed. The maximum potential gradient of 6.67 kV/cm lies within the range 0.05 kv/cm to 10 kV/cm given above.

The arrangement 20 including the workpiece 24 and the counter-electrodes 28, 29 was immersed vertically in the fluidised-bed for a time of 300 seconds during which the arrangement 20 was subjected to front-to-back oscillatory motion and, also, a vertical dipping motion, maintaining powder fluidity in the recesses of the workpiece 24. The process was carried out three times with different numbers of rods 28, 29 as described in the following three experiments. At the end of each experiment, the workpiece 24 was removed and subjected to a standard bake and cure. The remaining apparatus was thoroughly cleaned of deposited powder and reassembled along with a replacement workpiece 24.

Experiment 1

The second plurality of rods 29 were included without the first plurality of rods 28. At the end of the coating period, there was found to be 100% coverage of the rear recesses (as viewed) in the workpiece 24 facing the second plurality of rods 29. In the front recesses (as viewed) where the first plurality of rods 28 had been omitted, the workpiece 24 was found to be coated only to a depth of 4 cm below the upper edge and above the lower edge, the coating ending abruptly. The remainder of the front (as viewed) of the workpiece 24 was bare except for some specks of powder indicating virtually no powder deposition.

Experiment 2

Only half of the second plurality of rods 29 were included and so distributed that rod-present recesses alternated with rod-absent recesses. After the coating process was completed, those recesses in which rods had been present were found to be fully coated while there was coating in the recesses where there had been no rods only to 4 cm below the upper edge and above the lower edge of the workpiece 24. The front of the workpiece 24 was as for Experiment 1 above.

Experiment 3

Both the first and the second plurality of rods 28, 29 were included providing a rod in every recess in the workpiece 24. Full coating was achieved in both the front and rear recesses, the only bare areas being those which were in contact with the front and rear plates 25, 26.

The perceived advantage of the process described above is that the presence of the earthed counter-electrodes in the recesses so influences the electric field around the workpiece as to cause the electric field to extend fully into the recesses whereas, without the earthed counter-electrodes, the electric field penetrates only slightly into the recesses. The improved penetration of the electric field into the recesses leads to improved penetration of the powder. The full penetration into narrow recessed parts, as is demonstrated with this process, is important to prevent corrosion in narrow recesses parts and is difficult or even impossible to achieve with conventional coating processes.

Figure 16:
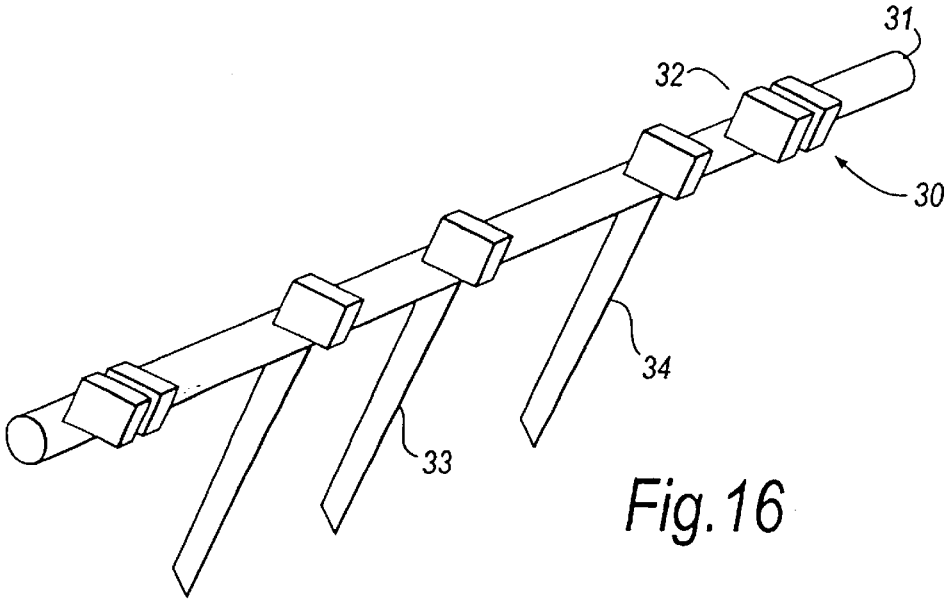
FIG. 16 is a diagrammatic perspective view of an arrangement for coating a plane workpiece between counter-electrodes and FIG. 17 is a plan view of the arrangement of FIG. 16 positioned on a fluidising chamber.

Referring to FIG. 16 of the accompanying drawings, an arrangement 30 used in carrying out Example 13, described below, includes a bar 31 carrying holders 33, 34 for a workpiece and counter-electrodes, respectively, and guides 32 for mounting the bar 31 on a fluidising chamber (not shown.

Figure 17:
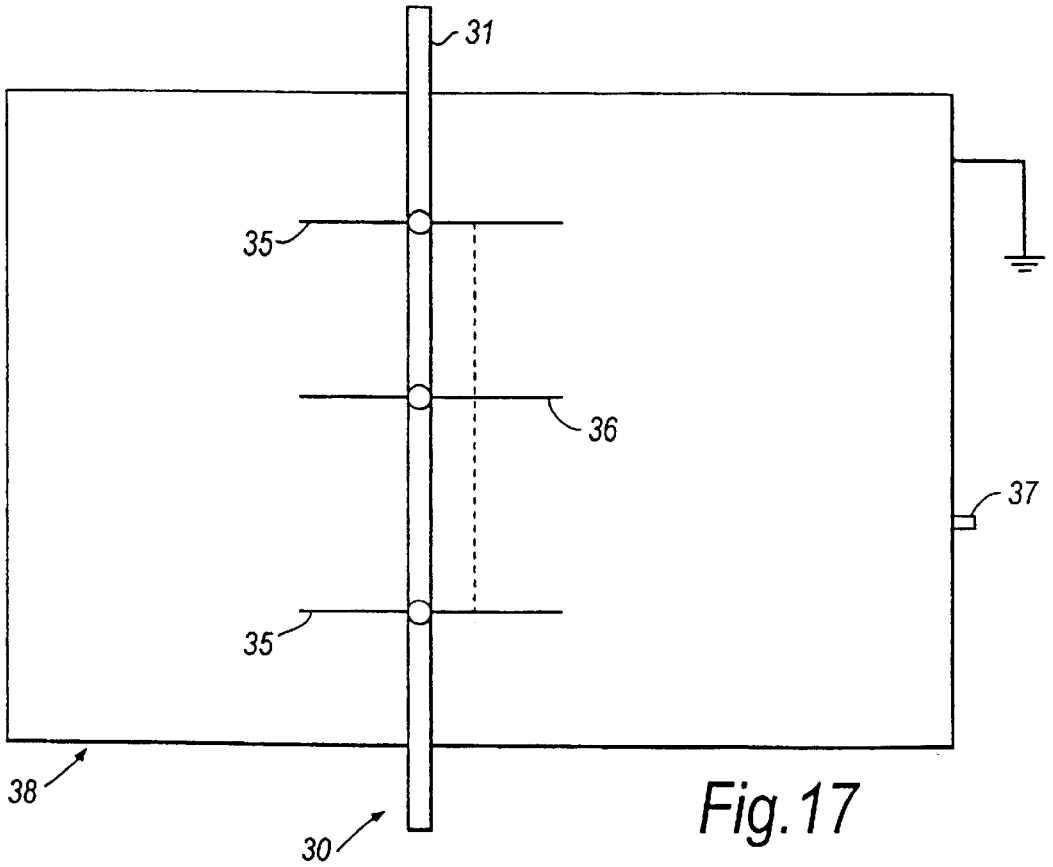

Referring to FIG. 17 of the accompanying drawings, the arrangement 30 of FIG. 16 is shown mounted on a fluidising chamber 38 provided with an air input port 37. In FIG. 17, the arrangement 30 of FIG. 16 is shown as carrying a plate-like workpiece 36 and flanked by plate-like counter-electrodes 35.

EXAMPLE 13

The powder coating composition used in this Example was a white epoxy/polyester hybrid formulated as in Example 4. The ingredients were dry mixed in a blender and fed into a twin screw extruder operating at a temperature of 108° C. The extrudate was ground in an impact mill to produce a powder with the following particle size distribution:

$d(v)_{99}$=59 microns $d(v)_{50}$=25 microns

9% <10 microns

3% <5 microns

Before fluidisation, the composition was blended with 0.25%, by weight, of a dry flow additive comprising alumina and aluminium hydroxide (45%:55% by weight).

The coating process was carried out as follows using the apparatus described above with reference to FIGS. 16 and 17:

The rectangular fluid bed 38 of dimensions 80 cm (length) by 40 cm (width) by 50 cm (height) was filled to three-quarter height with the above powder and fluidised at a pressure of 4 bar. A planar, rectangular aluminium panel of dimensions 15 cm by 10 cm, serving as the workpiece 36, was charged positively and immersed in the fluidised-bed for up to 150 seconds, the workpiece 36 being positioned between two negatively charged plates serving as counter-electrodes 35. The charged workpiece 36 was given a side-to-side motion for the duration of its immersion.

The perceived advantage of this process is the enhancement of the electric field between the workpiece 36 and the counter-electrodes 35 at the expense of the field between the workpiece 36 and the earthed walls of fluidising chamber 38. The reduction in the field between the workpiece 36 and the walls of the fluidising chamber 38 results in a reduction in the undesirable accumulation of powder on the walls of the fluidising chamber 38.

Table 11, below, summarises the characteristics of the finished coating after a standard bake and cure as a function of the voltages applied to the workpiece 36 and the counter-electrodes 35, demonstrating the influence of the counter-electrodes.

TABLE 11

| Voltage 1 | Voltage 2 | Area of Counter-Electrode | Dip | % | Film Thickness (μm) | | | Standard Deviation | PSD Deposited | | |
|---|---|---|---|---|---|---|---|---|---|---|---|
| (V) | (V) | ($cm^2$) | Time(s) | Coverage | Max | Min | Mean | σ | dv99 | dv50 | % <10 μm |
| 760 | −1434 | 300 | 43 | 100 | 116 | 52 | 82 | 19 | 26 | 13 | 28 |
| 1840 | −1166 | 250 | 137 | 100 | 172 | 139 | 154 | 8 | 30 | 15 | 23 |
| 1689 | −1060 | 150 | 96 | 100 | 140 | 115 | 128 | 7 | 25 | 13 | 32 |
| 911 | −1540 | 400 | 84 | 100 | 125 | 114 | 121 | 3 | 28 | 14 | 24 |

What is claimed is:

1. A process for forming a coating on a conductive substrate, which comprises establishing a fluidised bed of a powder coating composition, thereby effecting particle-charging of the powder coating composition by a mechanism consisting essentially of tribostatic charging of the powder coating composition in the fluidised bed, immersing the substrate wholly or partly within the said fluidised bed, applying a voltage to the substrate for at least part of the period of immersion, whereby charged particles of the powder coating composition adhere to the substrate, withdrawing the substrate from the fluidised bed and forming the adherent particles into a continuous coating over at least part of the substrate.

2. A process as claimed in claim 1, wherein the substrate comprises metal.

3. A process as claimed in claim 1, wherein the applied voltage is a direct-current voltage.

4. A process as claimed in claim 1, for coating successive substrates in sequence, in which direct-current voltage is used and the polarity of the voltage applied to successive substrates is reversed from each substrate to the next so as to produce an alternating sequence.

5. A process as claimed in claim 4, which is a continuous process in which a series of substrates of alternate polarities is transported through a fluidised bed established within a fluidising chamber having walls composed alternately, in the direction of travel of the substrates, of insulating sections and conducting sections.

6. A process as claimed in claim 1, which comprises the simultaneous batchwise coating of one or more pairs of substrates disposed within a common fluidised bed, the substrates of each pair being charged by direct-current voltages to respectively opposite polarities.

7. A process as claimed in claim 1, wherein the fluidised bed is established within an earthed vessel.

8. A process as claimed in claim 1, in which one or more counter-electrodes are disposed within the bulk of the powder coating composition.

9. A process as claimed in claim 1, wherein there is no earth connection to the substrate.

10. A process as claimed in claim 1, wherein the substrate is wholly immersed within the fluidised bed.

11. A process as claimed in claim 1, wherein there is no preheating of the substrate prior to immersion in the fluidised bed.

12. A process as claimed in claim 1, wherein the powder coating composition is a thermosetting system.

13. A process as claimed in claim 1, wherein the powder coating composition incorporates, by dry-blending, one or more fluidity-assisting additives.

14. A process as claimed in claim 13, wherein the powder coating composition incorporates a combination of alumina and aluminium hydroxide as a fluidity-assisting additive.

15. A process for coating a conductive substrate which comprises an automotive or aerospace component, in which a first coating derived from a powder coating composition is applied by a process according to claim 1, and thereafter a topcoat is applied over the powder coating.

16. Apparatus for use in a process as claimed in claim 1 for forming a coating on a conductive substrate, which comprises:

(a) a fluidising chamber;

(b) means for effecting fluidisation of a bulk powder coating composition within the fluidising chamber so as to establish a fluidised bed of the composition therein, thereby effecting particle-charging of the powder coating composition by a mechanism consisting essentially of tribostatic charging of the powder coating composition in the fluidised bed;

(c) means for immersing a substrate wholly or partly within the fluidised bed;

(d) means for applying a voltage to the substrates for at least part of the period of immersion, whereby the substrate becomes electrically charged so that charged particles of the powder coating composition adhere thereto;

(e) means for withdrawing the substrate bearing adherent particles from the fluidised bed; and (f) means for converting the adherent particles into a continuous coating.

17. A substrate coated by a process as claimed in claim 1.

18. A process as claimed in claim 1, wherein the voltage applied to the substrate is such that the maximum potential gradient existing in the fluidised bed lies substantially below the ionisation potential gradient for gas in the fluidised bed.

19. A process as claimed in claim 1, wherein a maximum potential gradient existing in the fluidised bed lies between 0.05 kV/cm and 10 kV/cm, both limits included.

20. A process as claimed in claim 19, wherein a maximum potential gradient existing in the fluidised bed lies between 0.05 kV/cm and 5 kV/cm, both limits included.

21. A process as claimed in claim 20, wherein a maximum potential gradient existing in the fluidised bed lies between 0.05 kV/cm and 1 kV/cm, both limits included.

22. A process as claimed in claim 1, wherein the voltage applied to the substrate (6) lies between 5 kV and 60 kV, both limits included.

23. A process as claimed in claim 22, wherein the voltage applied to the substrate (6) lies between 15 kV and 35 kV, both limits included.

24. A process as claimed in claim 22, wherein the voltage applied to the substrate (6) lies between 5 kV and 30 kV, both limits included.

25. A process as claimed in claim 22, wherein the voltage applied to the substrate (6) lies between 30 kV and 60 kV, both limits included.

26. A process as claimed in claim 1, wherein the particles of the powder coating composition vary in size between 1 and 120 microns, both limits included.

27. A process as claimed in claim 26, wherein the particles vary in size between 15 and 75 microns, both limits included.

28. A process as claimed in claim 27, wherein the particles vary in size between 25 and 50 microns, both limits included.

29. A process as claimed in claim 27, wherein the particles vary in size between 20 and 45 microns, both limits included.

30. A process as claimed in claim 1, wherein the substrate receives a continuous coating of thickness between 5 and 200 microns, both limits included.

31. A process as claimed in claim 30, wherein the substrate receives a continuous coating of thickness between 5 and 100 microns, both limits included.

32. A process as claimed in claim 30, wherein the substrate receives a continuous coating of thickness between 10 and 150 microns, both limits included.

33. A process as claimed in claim 32, wherein the substrate receives a continuous coating of thickness between 20 and 100 microns, both limits included.

34. A process as claimed in claim 33, wherein the substrate receives a continuous coating of thickness between 60 and 80 microns, both limits included.

35. A process as claimed in claim 33, wherein the substrate receives a continuous coating of thickness between 80 and 100 microns, both limits included.

36. A process as claimed in claim 31, wherein the substrate receives a continuous coating of thickness between 50 and 150 microns, both limits included.

37. A process as claimed in claim 32, wherein the substrate receives a continuous coating of thickness between 15 and 40 microns, both limits included.

38. A process as claimed in claim 1, wherein less than 10 mA flows in the substrate.

39. A process as claimed in claim 38, wherein less than 5 mA flows in the substrate.

40. A process as claimed in claim 39, wherein less than 1 mA flows in the substrate.

41. A substrate coated by a process as claimed in claim 18.

42. The process of claim 8, wherein the counter-electrodes are earthed.

* * * * *